US008460481B2

(12) United States Patent
Azuma et al.

(10) Patent No.: US 8,460,481 B2
(45) Date of Patent: Jun. 11, 2013

(54) HIGH-STRENGTH STEEL SHEET AND GALVANIZED STEEL SHEET HAVING VERY GOOD BALANCE BETWEEN HOLE EXPANSIBILITY AND DUCTILITY, AND ALSO EXCELLENT IN FATIGUE RESISTANCE, AND METHODS OF PRODUCING THE STEEL SHEETS

(75) Inventors: Masafumi Azuma, Tokyo (JP); Noriyuki Suzuki, Tokyo (JP); Naoki Maruyama, Tokyo (JP); Naoki Yoshinaga, Tokyo (JP); Akinobu Murasato, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 198 days.

(21) Appl. No.: 12/736,417

(22) PCT Filed: Apr. 9, 2009

(86) PCT No.: PCT/JP2009/057626

§ 371 (c)(1),
(2), (4) Date: Oct. 6, 2010

(87) PCT Pub. No.: WO2009/125874

PCT Pub. Date: Oct. 15, 2009

(65) Prior Publication Data

US 2011/0024004 A1 Feb. 3, 2011

(30) Foreign Application Priority Data

Apr. 10, 2008 (JP) ..... 2008-102851

(51) Int. Cl.

| | |
|---|---|
| ***C22C 38/02*** | (2006.01) |
| ***C22C 38/04*** | (2006.01) |
| ***C21D 8/04*** | (2006.01) |
| ***C23C 2/06*** | (2006.01) |

(52) U.S. Cl.
USPC ..... 148/320; 148/332; 148/333; 148/334; 148/335; 148/336; 148/518; 148/533; 148/651; 148/652

(58) Field of Classification Search
USPC ..... 148/320, 332–336, 518, 533, 603, 148/651, 652
See application file for complete search history.

(56) References Cited

U.S. PATENT DOCUMENTS 5,470,529 A 11/1995 Nomura et al.
5,618,355 A * 4/1997 Koyama et al. ..... 148/320

(Continued)

FOREIGN PATENT DOCUMENTS

EP 1 207 213 5/2002
EP 1 306 456 5/2003

(Continued)

OTHER PUBLICATIONS

Machine-English translation of Japanese patent 2007-231369, Azuma Masashi et al., Sep. 13, 2007.*

(Continued)

*Primary Examiner* — Deborah Yee
(74) *Attorney, Agent, or Firm* — Kenyon & Kenyon LLP

(57) ABSTRACT

The invention is directed to providing, for application in automobiles, construction materials, household appliances and the like, high-strength sheets excellent in formability properties such as hole expansibility and ductility, and also in fatigue resistance, characterized in comprising, in specified contents expressed in mass %, C, Si, Mn, P, S, Al, N and O and a balance of iron and unavoidable impurities, and having a steel sheet structure composed mainly of ferrite and hard structures, a crystal orientation difference between some ferrite adjacent to hard structures and the hard structures of less than 9°, and a maximum tensile strength of 540 MPa or greater.

10 Claims, 2 Drawing Sheets

U.S. PATENT DOCUMENTS

| | | | | |
|---|---|---|---|---|
| 7,067,023 | B2 * | 6/2006 | Kami et al. | 148/651 |
| 7,749,343 | B2 * | 7/2010 | Yoshinaga et al. | 148/603 |
| 2003/0015263 | A1 * | 1/2003 | Kami et al. | 148/603 |
| 2004/0050461 | A1 * | 3/2004 | Kami et al. | 148/603 |
| 2004/0103962 | A1 * | 6/2004 | Kami et al. | 148/603 |
| 2007/0029015 | A1 | 2/2007 | Yoshinaga et al. | |

FOREIGN PATENT DOCUMENTS

| | | |
|---|---|---|
| EP | 1 354 972 | 10/2003 |
| EP | 1 707 645 | 10/2006 |
| EP | 1 808 505 | 7/2007 |
| JP | 53-022812 | 3/1978 |
| JP | 57-137453 | 8/1982 |
| JP | 63-293121 | 11/1988 |
| JP | 01-230715 | 9/1989 |
| JP | 05-179345 | 7/1993 |
| JP | 11-279691 | 10/1999 |
| JP | 2001-192767 | 7/2001 |
| JP | 2003-321733 | 11/2003 |
| JP | 2004-256906 | 9/2004 |
| JP | 2005-290440 | 10/2005 |
| JP | 2007-231369 | 9/2007 |
| JP | 2007-284783 | 11/2007 |
| KR | 10-2006-0096002 | 9/2006 |

OTHER PUBLICATIONS

International Search Report dated Jul. 21, 2009 issued in corresponding PCT Application No. PCT/JP2009/057626.

CAMP-ISIJ vol. 13 (2000), p. 391-394.

CAMP-ISIJ vol. 13 (2000), p. 411-414.

European Search Report dated Sep. 27, 2011 issued in corresponding European Application No. 09 730 413.3.

* cited by examiner

HIGH-STRENGTH STEEL SHEET AND GALVANIZED STEEL SHEET HAVING VERY GOOD BALANCE BETWEEN HOLE EXPANSIBILITY AND DUCTILITY, AND ALSO EXCELLENT IN FATIGUE RESISTANCE, AND METHODS OF PRODUCING THE STEEL SHEETS

This application is a national stage application of International Application No. PCT/JP2009/057626, filed 9 Apr. 2009, which claims priority to Japanese Application No. 2008-102851, filed 10 Apr. 2008, which is incorporated by reference in its entirety.

FIELD OF THE INVENTION

This invention relates to steel sheets suitable for application in automobiles, construction materials, household appliances and the like, specifically high-strength steel sheet and galvanized steel sheet which are excellent in hole expansibility, ductility and other workability properties, and also excellent in fatigue resistance, and to methods of producing the steel sheets.

DESCRIPTION OF THE RELATED ART

In recent years, it has become the practice in the automotive sector to utilize high-strength steel sheet for both the purpose of establishing passenger protection capability during collision and the purpose of reducing weight in order to improve fuel efficiency.

Heightening safety awareness and stricter legal regulations have increased the need to ensure impact safety. As a result, a need has arisen to apply high-strength steel sheet even to complicatedly shaped components for which only low-strength steel sheet has been used in the past.

However, the formability of a steel declines with increasing steel strength, so that when a high-strength steel sheet is to be used for complicatedly shaped components, it becomes necessary to produce a steel that satisfies both the formability and strength requirements.

In utilizing a high-strength steel sheet for complicatedly shaped components such as automotive components, the formability properties that must be simultaneously provided include various different ones such as ductility, stretch-flanging formability, and hole expansibility.

Moreover, automotive components also require excellent fatigue resistance because they are subjected to repeated loading during driving.

The ductility and stretch-formability that are important as thin steel sheet formability properties and the working hardening index (n value) are known to be correlated. It is known that a steel sheet having a high n value is a steel sheet excellent in formability.

Steel sheets excellent in ductility and/or stretch-formability include, for example, the DP (Dual Phase) steel sheet having a steel sheet structure composed of ferrite and martensite, and the TRIP (Transformation Induced Plasticity) steel sheet whose steel sheet structure includes retained austenite (see, for example, Patent Document 1 and 2).

On the other hand, as steel sheets excellent in hole expansibility, there are known steel sheet whose structure is a precipitation-hardened ferrite single-phase structure and steel sheet having a bainite single-phase structure (see, for example, Patent Documents 3, 4, 5 and 6, and Non-patent document 1).

DP steel sheet has highly ductile ferrite as its main phase and achieves excellent ductility by dispersing martensite, a hard structure, in the steel sheet structure. Moreover, DP steel sheet is also high in n value because the soft ferrite readily deforms and abundant dislocations are introduced at the time of deformation.

However, when a steel sheet structure composed of soft ferrite and hard martensite is adopted, the difference in deformability between the two structures causes formation of minute microvoids at the interface between the two structures when heavy working is involved as in the case of hole expansion, so that there is a problem of marked degradation of hole expansibility.

Particularly in a DP steel sheet of a maximum tensile strength of 540. MPa or greater, the martensite volume fraction in the steel sheet becomes relatively high, and since many interfaces between ferrite and martensite are therefore present, the microvoids formed at the interfaces readily interconnect, leading to crack formation and breakage.

For such reason, the hole expansibility of DP steel sheet is known to be inferior (see, for example, Non-Patent Document 2).

It is known that in a DP steel cracks formed during repeated deformation improve fatigue resistance (crack propagation suppression) by by-passing hard structures. This is attributable to the fact that martensite and bainite are harder than ferrite, and since fatigue cracks cannot propagate through them, the fatigue cracks propagate on the ferrite side or at the interfaces between ferrite structures and the hard structures, thereby by by-passing the hard structures.

In DP steel, the hard structures do not readily deform, so that the dislocation movement and change in surface irregularities produced by repeated deformation are borne by dislocation movement on the ferrite side. As a result, it is important for further improvement of the fatigue resistance of DP steel to inhibit formation of fatigue cracks in the ferrite. However, ferrite is soft, so that the difficulty of inhibiting crack formation in the ferrite poses a problem. Further improvement of DP steel fatigue resistance therefore still faces a challenge.

Similarly, TRIP steel sheet, which has a structure composed of ferrite and retained austenite, also has poor hole expansibility. This is because the automotive component forming processes, i.e., the hole expansion and stretch flanging, are machining processes conducted after punching or mechanical cutting.

The retained austenite contained in the TRIP steel sheet transforms to martensite when worked. In the case of ductile drawing and stretch forming, for example, the transformation of retained austenite to martensite imparts high strength to the worked region, thereby inhibiting deformation concentration, so that high formability can be realized.

However, once punching, cutting or the like has been conducted, retained austenite contained in the steel sheet structure transforms to martensite owing to the working imparted in the vicinity of the cut edge. As a result, the structure becomes similar to that of DP steel sheet, so that hole expansibility and stretch flanging formability becomes inferior. Moreover, it has been reported that since punching is itself a process involving large deformation, hole expansibility is degraded by microvoids that after punching come to be present at the interfaces between the ferrite structures and the hard structures (here meaning martensite transformed from retained austenite).

Steel sheet in which cementite or pearlite structures are present at the structure boundaries is also inferior in hole expansibility. This is because the boundaries between ferrite structures and cementite structures become starting points for minute void formation.

Moreover, owing to their hard structures, TRIP steel plate and steel plate having cementite or pearlite structure at the structure boundaries are similar to DP steel as regards fatigue resistance.

In view of these circumstances, as indicated in Patent Documents 3 to 5 and Non-Patent Document 1, there have been developed high-strength hot-rolled steel sheets imparted with excellent hole expansibility by defining the main phase of the steel sheet as a single-phase structure of bainite or precipitation-hardened ferrite and inhibiting formation of cementite phase at the structure boundaries by adding a large amount of Ti or other alloy carbide forming element to convert C contained in the steel to alloy carbide.

However, when the steel sheet is given a bainite single-phase structure, the productivity of the steel sheet is poor because the fact that the steel sheet structure is bainite single-phase makes it necessary in the production of the cold-rolled steel sheet to once heat to a high temperature at which the structure becomes austenite single phase. In addition, owing to the fact that the bainite structure contains many dislocations, workability is poor, so that there is a drawback in that application to components requiring ductility and stretchability is difficult.

Moreover, the steel sheet given a precipitation-hardened ferrite single-phase structure utilizes precipitation hardening by carbides of Ti, Nb, Mo and the like to impart high strength to the steel sheet and further inhibits formation of cementite and the like, thereby making it possible to achieve both high strength of 780 MPa or greater and excellent hole expansibility. However, there is a drawback in that the precipitation hardening is difficult to utilize in a cold-rolled steel sheet that passes through cold rolling and annealing.

More specifically, the precipitation hardening is achieved by coherent precipitation of Nb, Ti or other alloy carbides in the ferrite, and since in the cold-rolled steel sheet the ferrite is worked and recrystallized during the ensuing annealing, the orientation relative to the Nb or Ti precipitates that were coherently precipitated at the hot-rolled steel sheet stage is lost. As a result, strength becomes difficult to achieve owing to a large decline in strengthening effect.

It is also known that Nb or Ti added to a precipitation-hardened steel greatly delays recrystallization, so that high-temperature annealing becomes necessary for ensuring excellent ductility, thus degrading productivity. Moreover, even if ductility on a par with that of the hot-rolled steel sheet can be obtained in the cold-rolled steel sheet, its ductility and stretch formability are inferior to those of a DP steel sheet, so that application to regions requiring large stretchability is impossible, while a problem of cost increase also arises owing to the need to add a large amount of Nb, Ti or other expensive alloy carbide forming elements.

Although inferior to that in DP steel, there is some degree of fatigue resistance improving effect in a precipitation-hardened steel. This is because the precipitates hinder dislocation movement, thus suppressing formation on the surface of irregularities that cause fatigue cracking, whereby formation of cracks at the surface is inhibited.

However, in a precipitation-hardened steel, once irregularities form on the surface, large stress concentration occurs at the sites of the irregularities, so that crack propagation cannot be inhibited. Fatigue resistance improvement by precipitation hardening thus has its limit.

As steel sheets intended to overcome these drawbacks and ensure ductility and hole expansibility, there are known the steel sheets taught by, inter alia, Patent Documents 6 and 7.

These are directed to once establishing a composite structure of ferrite and martensite in the steel sheet and thereafter temper-softening the martensite, thereby simultaneously realizing an improvement in the balance between strength achieved by structure strengthening and ductility and an improvement in hole expansibility.

However, degradation of hole expansibility cannot be avoided because even though the hard structure is softened by tempering the martensite, the martensite still remains hard. In addition, the softening of the martensite reduces strength, making it necessary to increase the martensite volume fraction in order to offset the strength decrease, so that there has been a problem of the increase in hard structure volume fraction giving rise to hole expansibility degradation. Another problem has been that the steel properties tend to lack uniformity because fluctuation of the cooling end point temperature makes the martensite volume fraction uneven.

As a way of solving these problems, or of ensuring adequate martensite volume fraction, an adequate amount of martensite volume fraction is sometimes secured by using a water tank or the like for quenching to room temperature, but when quenching is conducted using water or the like, shape defects such as steel sheet warping and post-cutting camber tend to occur.

The cause of these shape defects is not simply sheet deformation and in some cases the cause is residual stress attributable to uneven temperature during cooling, so that even when the sheet shape is good, shape defects like post-cutting warp and camber sometimes arise. There is also an issue of straightening in a later processing process being difficult. So there are problems not only in the point of ensuring steel quality but also from the viewpoint of ease of use.

Thus, the steel sheet structures required for realizing ductility, stretch formability, and hole expansibility differ very greatly, so that it is very difficult to provide a steel sheet having these properties simultaneously. And there has also been a problem regarding further improvement of fatigue durability.

PRIOR ART DOCUMENTS

Patent Documents

Patent Document 1 Japanese Patent Publication (A) No. S53-22812

Patent Document 2 Japanese Patent Publication (A) No. H1-230715

Patent Document 3 Japanese Patent Publication (A) No. 2003-321733

Patent Document 4 Japanese Patent Publication (A) No. 2004-256906

Patent Document 5 Japanese Patent Publication (A) No. H11-279691

Patent Document 6 Japanese Patent Publication (A) No. S63-293121

Patent Document 7 Japanese Patent Publication (A) No. S57-137453

Non-Patent Documents

Non-Patent Document 1 CAMP-ISIJ vol. 13 (2000), p 411

Non-Patent Document 2 CAMP-ISIJ vol. 13 (2000), p 391

SUMMARY OF THE INVENTION

Problem to be Solved by the Invention

As set out in the foregoing, in order to increase ductility, it is desirable to give the steel sheet a composite structure composed of soft structure and hard structure, and for increasing hole expansibility, it is desirable to establish a uniform structure having small hardness difference between structures.

Thus, the structures required for establishing the properties of ductility and hole expansibility are different, and it has therefore been considered difficult to provide a steel sheet exhibiting both properties. In addition, attempts have made to further improve fatigue resistance.

The present invention was accomplished in consideration of these circumstances and provides a steel sheet that achieves both excellent ductility on a par with DP steel and excellent hole expansibility on a par with that possessed by a single structure steel sheet, while also achieving high strength, and that in addition is improved in fatigue resistance, and also provides a method of producing the steel sheet.

Means for Solving the Problem

The characterizing features of the present invention are as follows.

(1) This invention provides a high-strength steel sheet having very good balance between hole expansibility and ductility, and also excellent in fatigue resistance, characterized in comprising, in mass %, C: 0.05 to 0.20%, Si: 0.3 to 2.0%, Mn: 1.3 to 2.6%, P: 0.001 to 0.03%, S: 0.0001 to 0.01%, Al: 2.0% or less, N: 0.0005 to 0.0100%, O: 0.0005 to 0.007%, and a balance of iron and unavoidable impurities; and having a steel sheet structure composed mainly of ferrite and hard structure, a crystal orientation difference between some ferrite adjacent to hard structure and the hard structure of less than 9°, and a maximum tensile strength of 540 MPa or greater.

(2) This invention is characterized in further comprising, in mass %, B: 0.0001 to less than 0.010%.

(3) This invention is characterized in further comprising, in mass %, one or two or more of Cr: 0.01 to 1.0%, Ni: 0.01 to 1.0%, Cu: 0.01 to 1.0%, and Mo: 0.01 to 1.0%.

(4) This invention is characterized in further comprising, in mass %, one or two or more of Nb, Ti and V in a total of 0.001 to 0.14%.

(5) This invention is characterized in further comprising, in mass %, one or two or more of Ca, Ce, Mg, and REM in a total of 0.0001 to 0.5%.

(6) This invention is characterized in that a surface of a steel sheet in accordance with any of (1) to (5) has a zinc-based plating.

(7) This invention provides a method of producing a high-strength steel sheet having very good balance between hole expansibility and ductility, and also excellent in fatigue resistance, characterized in heating a cast slab having a chemical composition in accordance with any of (1) to (5), directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous annealing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater; and holding in a temperature range of 450° C. to 300° C. for 30 sec or greater.

(8) This invention provides a method of producing a high-strength hot-dip galvanized steel sheet having very good balance between hole expansibility and ductility, and also excellent in fatigue resistance, characterized in heating a cast slab having a chemical composition in accordance with any of (1) to (5), directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous hot-dip galvanizing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater to a temperature of (galvanizing bath temperature−40)° C. to (galvanizing bath temperature+50)° C.; and holding in a temperature range of (galvanizing bath temperature+50)° C. to 300° C. for 30 sec or greater either before or after or both before and after immersion in the galvanizing bath.

(9) This invention provides a method of producing a high-strength alloyed hot-dip galvanized steel sheet having very good balance between hole expansibility and ductility, and also excellent in fatigue resistance, characterized in heating a cast slab having a chemical composition in accordance with any of (1) to (5), directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous hot-dip galvanizing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater to a temperature of (galvanizing bath temperature−40)° C. to (galvanizing bath temperature+50)° C.; conducting alloying treatment at a temperature of 460 to 540° C. as required, and holding in a temperature range of (galvanizing bath temperature+50)° C. to 300° C. for 30 sec or greater before or after immersion in the galvanizing bath or after alloying treatment or in total.

(10) This invention provides a method of producing a high-strength electro-galvanized steel sheet having very good balance between hole expansibility and ductility, and also excellent in fatigue resistance, characterized in electro-galvanizing a steel sheet produced in accordance with the method of (7).

Effect of the Invention

The present invention controls steel sheet composition and annealing conditions to enable reliable provision of high-strength steel sheet and high-strength galvanized steel sheet that are composed mainly of ferrite and hard structure, have a crystal orientation difference between adjacent ferrite and the hard structure within 9°, and therefore have excellent ductility at a maximum tensile strength of 540 MPa or greater and excellent hole expansibility, as well as excellent fatigue resistance.

DETAILED DESCRIPTION OF THE INVENTION

Figure 1:
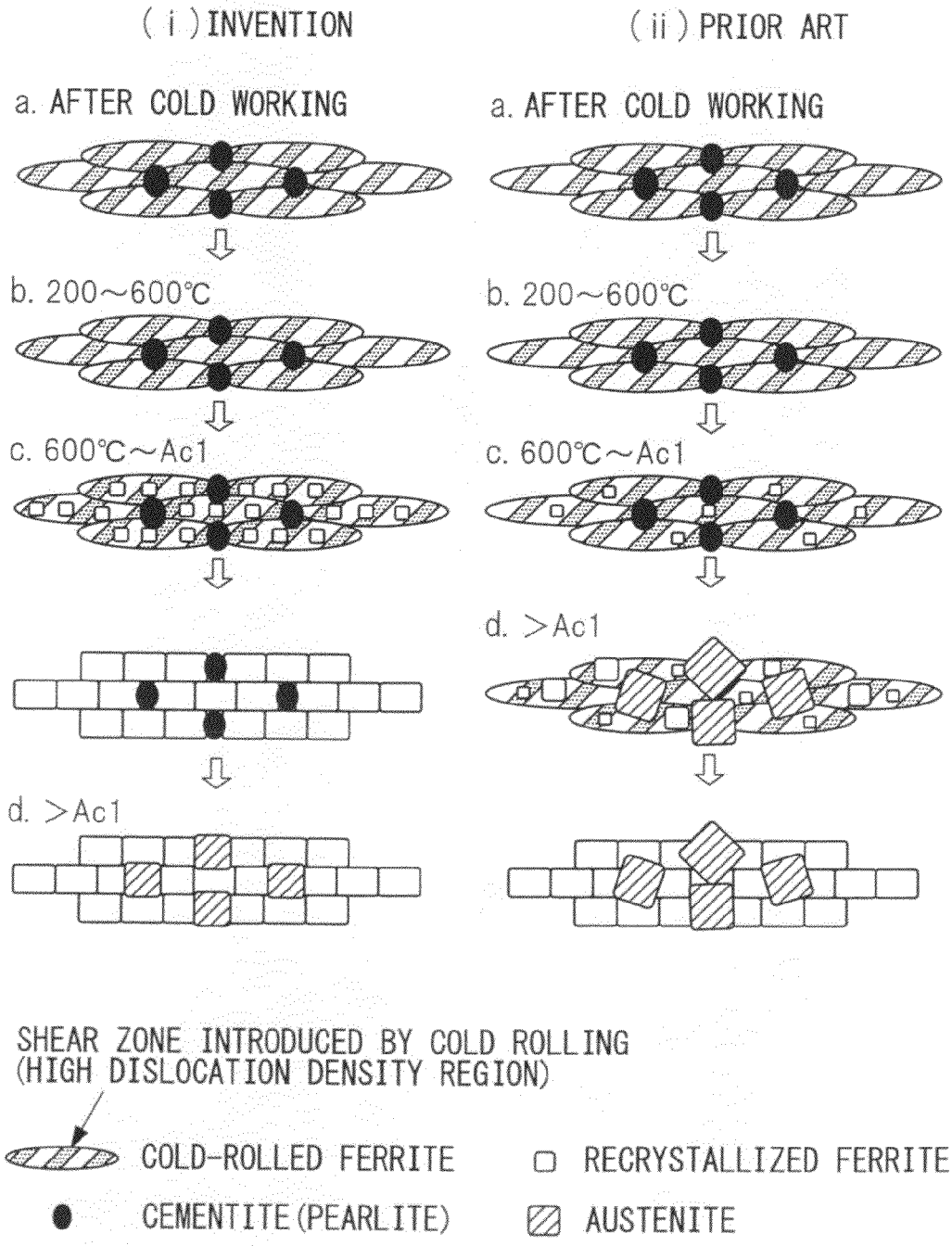
FIG. 1 is a set of diagrams schematically illustrating phase transformation when steels were heated to Ac1 temperature or higher after cold working, wherein (i) indicates the case of the present invention and (ii) indicates the case of the prior art.

The present invention is explained in detail in the following.

The inventors conducted a study for the purpose of enabling establishment of both excellent ductility and excellent hole expansibility in a high-strength steel sheet having a maximum tensile strength of 540 MPa or greater even when the steel sheet is imparted with a structure of ferrite and hard structure.

As a result, they discovered that by making the proportion of hard structures whose crystal orientation difference relative to some ferrite structures adjacent to the hard structures is within 9° equal to 50% or greater of the total hard structure volume fraction, i.e., by establishing a hard structure whose structures have a crystal orientation difference with respect to some adjacent ferrite structures of less than 9° as the main structure, it is possible to ensure excellent hole expansibility while also securing the excellent ductility that characterizes a composite structure steel plate. They further discovered that the so-constituted steels sheet is also excellent in fatigue resistance.

The reasons for defining the structure of the steel will be explained first.

Ferrite, which is a soft structure, generally differs in deformability from hard structures like bainite and martensite. In a steel sheet composed of ferrite and hard structures, the soft ferrite deforms easily but the hard bainite or martensite do not readily deform. As a result, when such a steel sheet is subjected to heavy deformation as in hole expansion or stretch flanging, deformation concentrates at the interface between the hard and soft structures, leading to microvoid formation, cracking, crack propagation and breakage. Therefore, such steel sheets have been considered incapable of achieving both excellent ductility and excellent hole expansibility.

Moreover, as regards fatigue resistance, another problem is that fatigue cracking is hard to control because the cracks propagate on the ferrite side or along the interface between the ferrite structures and the hard structures.

However, further research conducted by the inventors revealed that even hard structures can deform provided that their orientation difference relative to adjacent ferrite structure is small. In addition, the inventors found that when hard structures having crystal orientation similar to ferrite are caused to be adjacent to ferrite (hard structures with small crystal orientation difference are caused to be adjacent between ferrite structures and hard structures having random crystal orientations), hole expansibility is not degraded even when hard structures differing in crystal orientation are present.

This is thought to be attributable to the fact that the crystal structures of ferrite and the hard structures are similar. Specifically, it is thought that since the two structures are similar in crystal structure, their dislocation slip systems during deformation are also similar. Moreover, it is believed that when the crystal orientation difference between the two is small, deformation similar to that occurring in the ferrite also occurs in the hard structures.

From this it can be concluded that by controlling the crystal orientation of hard structures adjacent to ferrite structures, the volume fraction of dislocations and microvoid formation at the interfaces can be controlled to improve hole expansibility.

It is also thought that even when hard structures differing in crystal orientation from ferrite are present, the difference in deformability is small because hard structures having crystal orientation similar to ferrite are present therearound and both are hard structures, and that high strength is therefore imparted without degrading hole expansibility.

In addition, it is considered that under heavy deformation like hole expansion, deformation of even hard structures is possible because the ferrite is also considerably hard owing to working hardening, so that the difference in deformability between it and the hard structures is small.

On the other hand, at the start of deformation, ferrite is in an easily deformable condition because it has not yet experienced much working and is still soft. This is thought to be why reduction of the orientation difference between the hard structures and adjacent ferrite made it possible to simultaneously establish ductility and hole expansibility like those of a composite structure steel plate.

Further, reducing the difference between the crystal orientation of the hard structures and the crystal orientation of adjacent ferrite structures makes deformation of the hard structures during repeated deformation possible. It is considered that, as a result, the hard structures are also deformed during repeated deformation, so that behavior just like that when ferrite is strengthened is exhibited, thereby inhibiting formation of fatigue cracks. At the same time, the hard structures still remain hard, so that an effect of resisting propagation of once-formed cracks is also observed. These factors are believed to account for the improvement also in fatigue resistance of the steel.

These effects are pronounced when the volume fraction of hard structures (particularly bainite) whose difference in crystal orientation from that of adjacent ferrite is within 9° accounts for 50% or greater of the total hard structure volume fraction.

If the angle exceeds 9°, deformability is deficient even under heavy deformation, so that distortion concentration and microvoid formation at the ferrite-hard structure interfaces is promoted and hole expansibility is markedly degraded. The crystal orientation difference therefore must be 9° or less.

Not all ferrite adjacent to hard structures is required to be ferrite satisfying the crystal orientation relationship of a crystal orientation difference of 9° or less. It suffices to satisfy a crystal orientation relationship wherein the crystal orientation difference between hard structures and some adjacent ferrite is less than 9°. Although it is desirable for the crystal orientation difference between the hard structures and all adjacent ferrite structures to be less than 9°, this is very difficult technically because it requires all ferrite to be given the same orientation.

Even if the crystal orientation difference should be great relative to one adjacent ferrite structure, deformation of ferrite having the same orientation makes it possible to mitigate concentration of distortion at the interface with the hard structure. In addition, the formed hard structures usually have crystal orientation similar to the ferrite to which the most interfaces are adjacent.

The inventors believe this is why hole expansibility improvement was achieved owing to suppression of microvoid formation even if not all adjacent ferrite and hard structures had the aforesaid orientation relationship.

The volume fraction of hard structures adjacent to ferrite whose crystal orientation difference relative to the hard structures is less than 9° is desirably made 50% or greater of all hard structures. This because at a volume fraction of less than 50%, the suppression effect of microvoid formation suppression on hole expansibility is small.

On the other hand, in the case where 50% or greater of the total hard structure volume fraction has the specified crystal orientation relationship with ferrite (crystal orientation difference within)$_9$°, then even if hard structures not having the specified crystal orientation relationship are present, these hard structures are surrounded by the hard structures having the crystal orientation relationship, so that the percentage thereof having interfaces in contact with ferrite becomes small, and since they therefore do not readily become deformation concentration or microvoid formation sites, hole expansibility improves.

In this invention, the steel sheet is given the aforesaid composite structure of ferrite and hard structures. By "hard structures" as termed here is meant bainite, martensite and retained austenite. Like ferrite, bainite has a bcc structure. In some case, it is a structure containing cementite or retained austenite inside or between the lath-like or block-like bainitic ferrite constituting the bainite structure. Since bainite has a smaller grain diameter than ferrite, and its transformation temperature is low, it contains many dislocations and is therefore harder than ferrite. On the other hand, martensite is very hard because it has a bct structure and contains much C inside.

The volume fraction of hard structures is preferably made 5% or greater. This is because strength of 540 MPa or greater is hard to establish at a hard structure volume fraction of less than 5%. More preferably, 50% or greater of the total volume fraction of bainite, martensite and retained austenite present in the steel sheet is made martensite structure. This is because martensite is harder than bainite, thus offering higher strength at a lower volume fraction.

As a result, hole expansibility can be improved while retaining ductility on a par with that of conventional DP steel. On the other hand, excellent hole expansibility can be achieved even if all of the hard structure is made bainite structure, but when high strength of 540 MPa or greater is sought, the bainite volume fraction becomes too large and the proportion of highly ductile ferrite declines excessively, so that ductility is markedly degraded. In view of this, 50% or greater of the hard structure volume fraction is preferably martensite.

In addition, distribution of hard structures having a crystal orientation difference of 9° or less between ferrite and hard structures not having the crystal orientation relationship further improves the balance between hole expansibility and elongation. This is because adjacent positioning of structures of nearly the same deformability inhibits concentration of deformation at the structure interfaces, thereby improving hole expansibility.

As another hard structure, retained austenite can be incorporated. By transforming to martensite during deformation, retained austenite hardens the worked region to prevent concentration of deformation. As a result, particularly outstanding ductility can be obtained.

Although the invention effect of establishing excellent ductility and hole expansibility, as well as fatigue resistance, can be realized without particularly specifying an upper limit of hard structure volume fraction, good steel sheet ductility and hole expansibility can be achieved together with good stretch-flanging property in the TS range of 590 to 1,080 MPa, while it is further desirable for ensuring fatigue resistance to incorporate ferrite at a volume fraction of greater than 50%.

The purpose in giving the steel sheet a composite structure of ferrite and hard structure is to achieve excellent ductility. As ferrite offers high ductility, it is indispensable for obtaining excellent ductility. Further, by dispersing a suitable amount of hard structure, high strength can be established while maintaining the excellent ductility. In order to secure excellent ductility, the main phase of the steel sheet must be ferrite.

Other structures such as pearlite and cementite can also be incorporated to the extent that they do not degrade strength, hole expansibility and ductility.

The aforesaid ferrite, pearlite cementite, martensite, bainite, austenite and residual microstructures can be identified and their locations and area fractions determined by using nital solution and the reagent taught by Japanese Patent Publication (A) No. S59-219473 to etch a cross-section of the steel sheet taken in the rolling direction or a cross-section taken perpendicular to the rolling direction and conducting observation with a ×1000 optical microscope and quantification with ×1000 to ×100000 scanning and transmission electron microscopes. The structures can also be discriminated by crystal orientation analysis using FESEM-EBSP (high-resolution crystal orientation analysis) or micro-region hardness measurement by micro-Vickers testing or the like.

Crystal orientation relationships can be determined by internal structure observation using a transmission electron microscope (TEM) and crystal orientation mapping using the FESEM-EBSP technique. Crystal orientation mapping by the FESEM-EBSP technique is particularly effective because it enables simple measurement of large fields.

After taking a photograph using an SEM, the inventors used the FESEM-EBSP technique to map a 100 μm×100 μm field at a step size of 0.2 μm. But discrimination between bainite and martensite, which have similar crystal structures, is difficult solely by orientation analysis using the FESEM-EBSP technique. However, the martensite structure contains many dislocations and can therefore be easily discriminated by comparison with an Image Quality image.

More specifically, since martensite is a structure containing many dislocations, it can be easily discriminated from the fact that its Image Quality is much lower than those of ferrite and bainite. So when discrimination of bainite and martensite was done using the FESEM-EBSP technique, the inventors further used an Image Quality image for the discrimination. The area fractions of the respective structures can be determined by observing 10 or more fields of each and applying the point-count method or image analysis.

In determining crystal orientation differences, the relationship between the [1-1-1] crystal orientations that are the main slip directions of the ferrite main phase and adjacent hard structures were measured. However, even when the [1-1-1] orientations are the same, the orientation may be rotated around this axis. So the crystal orientation difference in the direction normal to the (110) plane, which is the [1-1-1] slip plane, was also measured, and structures in which both of the crystal orientation differences were 9° or less were defined as the "hard structures of 9° or less crystal orientation difference" as termed with respect to the present invention.

In deciding the orientation difference, steel sheets of various compositions were produced under various production conditions, and after being subjected to hole expansion testing, or embedding and polishing of a test piece after tensile testing, the deformation behaviour near the fracture region, particularly the microvoid formation behaviour, was investigated, whereupon it was found that microvoid formation was markedly inhibited at the ferrite-hard structure interfaces of adjacent ferrite and hard structures whose crystal orientation differences determined in the foregoing manner were 9° or less It was further found that a salient effect of improving hole expansibility and fatigue resistance is exhibited when the proportion of all hard structures accounted for by hard structures whose crystal orientation difference relative to ferrite structures adjacent to the hard structures is within 9° is controlled to 50% or greater.

This is because when hard structures are established so that 50% or greater of total hard structure volume fraction has the specified crystal orientation relationship with adjacent ferrite (crystal orientation difference within 9°), then even if hard structures not having the specified crystal orientation relationship are present, these hard structures are surrounded by the hard structures having the crystal orientation relationship, so that the percentage thereof having interfaces in contact with ferrite can be made small. They therefore do not readily become deformation concentration or microvoid formation sites so that hole expansibility improves.

It is therefore necessary for the proportion of all hard structures accounted for by hard structures with crystal orientation difference of less that 9° to be 50% or greater. Also worth noting is that controlling microvoid formation not only improves hole expansibility but also improves local elongation in tensile testing, so the invention composite structure steel plate controlled in the crystal orientation difference of the hard structures is superior to ordinary DP steel in local elongation.

The reason for defining TS as 540 MPa or greater is that where a lower strength suffices, excellent ductility and hole expansibility can both be realized at a TS of less than 540 MPa by using solid solution strengthening to impart high strength to a ferrite single phase steel. Of particular note is that when a TS of 540 MPa is desired, strengthening by use of martensite and/or retained austenite is required for ensuring excellent ductility, so that hole expansibility degradation is pronounced.

Although the invention does not particularly limit the ferrite grain diameter, a nominal grain diameter of 7 μm or less is preferable from the viewpoint of strength-elongation balance.

The reasons for defining the chemical composition of the steel constituting the invention steel sheet will be explained next.

C: 0.05 to 0.20%

C is a required element when using bainite and martensite for structure strengthening. When C content is less than 0.05%, strength of 540 MPa or greater is hard to achieve. The lower limit value is therefore defined as 0.05%. On the other hand, the reason for defining C content as 0.20% or less is that when C contents exceeds 0.20%, the hard structure volume fraction becomes too large, so that even if the crystal orientation difference between most of the hard structure and ferrite is 9°, or less, the volume fraction of unavoidably present hard structures not having the aforesaid crystal orientation relationship becomes excessive, thereby making it impossible to inhibit distortion concentration and microvoid formation at the interfaces and thus depressing the hole expansion value.

Si: 0.3 to 2.0%

Si is a strengthening element and, moreover, since it does not enter cementite in solid solution, it inhibits formation of coarse cementite at the interfaces. Si addition of 0.3% or greater is required because when less than 0.3% is added, no strengthening by solid solution strengthening is obtained and formation of coarse cementite at the interfaces cannot be inhibited. On the other hand, addition of greater than 2.0% excessively increases retained austenite, thereby degrading hole expansibility and flanging property following punching or cutting. The upper limit must therefore be defined as 2.0%. In addition, oxide of Si impairs wettability in hot-dip galvanization and is therefore a cause of non-plating defects. In the production of hot-dip galvanized steel sheet, therefore, the oxygen potential in the furnace must be controlled to inhibit Si oxide formation on the steel sheet surface.

Mn: 1.3 to 2.6%

Mn is a solid solution strengthening element, and since it is also an austenite stabilizing element, it inhibits transformation of austenite to pearlite. At a content of less than 1.3%, the rate of pearlite transformation is too fast, so that a steel sheet structure of composite ferrite and bainite cannot be realized, making it impossible to achieve TS of 540 MPa or greater. Hole expansibility is also poor. The lower limit of Mn content is therefore defined as 1.3% or greater. On the other hand, addition of a large amount of Mn promotes co-segregation of P and S, thereby markedly degrading workability. The upper limit of Mn content is therefore defined as 2.6%.

P: 0.001 to 0.03%

P tends to segregate at the middle of steel sheet thickness and causes weld embrittlement. At a content exceeding 0.03%, weld embrittlement becomes conspicuous, so the suitable content range is defined as 0.03% or less. Although no lower limit of P content need be defined, achieving a content of less than 0.001% is economically disadvantageous, so this value is preferably defined as the lower limit.

S: 0.0001 to 0.01%

S adversely affects weldability as well as productivity at the time of casting and hot rolling. The upper limit of S content is therefore defined as 0.01% or less. Although no lower limit of S content need be defined, achieving a content of less than 0.0001% is economically disadvantageous, so this value is preferably defined as the lower limit. Moreover, S combines with Mn to form coarse MnS, which decreases hole expansibility. Therefore, in order to improve hole expansibility, S content must be kept as low as possible.

Al: 2.0% or less

Al promotes ferrite formation and can therefore be added to improve ductility. It can also be utilized as a deoxidizer. However, excessive addition of Al increases the number of coarse Al-based inclusions and thus causes hole expansibility degradation and surface flaws. The upper limit of Al addition is therefore defined as 2.0%. Although no lower limit need be defined, a content of 0.0005% or less is difficult to achieve and, as such, is the substantial lower limit.

N: 0.0005 to 0.01%

N forms coarse nitrides that degrade bendability and hole expansibility, and the amount of added N must therefore be restricted. As this tendency becomes pronounced when N content exceeds 0.01%, the range of N content is defined as 0.01% or less. A lower content is also more preferable because N causes blowhole occurrence during welding. Although the invention can exhibit its effect without defining a lower limit of N content, achieving an N content of less than 0.0005% greatly increases production cost, so this value is the substantial lower limit.

O: 0.0005 to 0.007%

O forms oxides that degrade bendability and hole expansibility, and the amount of added 0 must therefore be restricted. Of particular note is that the oxides are usually present as inclusions and when the inclusions are present at a punched or cut face, notch-like flaws or large dimples form in the face, causing stress concentration during hole expansion or strong working and acting as crack formation starting points, thus causing significant degradation of hole expansibility and bendability.

As this tendency becomes strong when 0 content exceeds 0.007%, the upper limit of 0 content is defined as 0.007% or less. Reduction of 0 content to less than 0.0005% entails extra work for deoxidation during steelmaking, which is economically undesirable because it leads to excessive cost increase, so this value is defined as the lower limit. However, even if the content should be reduced to less than 0.0005%, the effects of the invention, namely TS of 540 MPa or greater and excellent ductility, can still be achieved.

Although the present invention is based on a steel containing the foregoing elements, the following elements may further be selectively incorporated in addition to the above elements.

B: 0.0001 to 0.010%

B is effective for grain boundary strengthening and steel strengthening at a content of 0.0001% or greater, while at a content exceeding 0.010%, not only does this effect saturate but productivity during hot rolling declines, so the upper content limit is defined as 0.010%.

Cr: 0.01 to 1.0%

Cr is a strengthening element and also important for hardenability improvement. At a content of less than 0.01%, however, these effects are not observed. The lower limit of Cr content is therefore defined as 0.01%. The upper content limit is defined as 1% because addition to a content exceeding 1% greatly increases cost.

Ni: 0.01 to 1.0%

Ni is a strengthening element and also important for hardenability improvement. At a content of less than 0.01%, however, these effects are not observed. The lower limit of Ni content is therefore defined as 0.01%. The upper content limit is defined as 1% because addition to a content exceeding 1% greatly increases cost.

Cu: 0.01 to 1.0%

Cu is a strengthening element and also important for hardenability improvement. At a content of less than 0.01%, however, these effects are not observed. The lower limit of Cu content is therefore defined as 0.01%. At a content exceeding 1%, Cu has an adverse effect on productivity during production and hot rolling. The upper content limit is therefore defined as 1%.

Mo: 0.01 to 1.0%

Mo is a strengthening element and also important for hardenability improvement. At a content of less than 0.01%, however, these effects are not observed. The lower limit of Mo content is therefore defined as 0.01%. The upper content limit is defined as 1% because addition to a content exceeding 1% greatly increases cost. Preferably, the upper limit is defined as 0.3% or less.

Nb: 0.001 to 0.14%

Nb is a strengthening element. It helps to elevate steel sheet strength through precipitate strengthening, grain-refining strengthening by inhibiting ferrite crystal grain growth, and dislocation strengthening by inhibiting recrystallization. The lower limit of Nb content is defined as 0.001% because these effects are not observed at an amount of Nb addition of less than 0.001%. The upper limit of Nb content is defined as 0.14% because heavy precipitation of carbonitrides degrades formability when Nb content exceeds 0.14%.

Ti: 0.001 to 0.14%

Ti is a strengthening element. It helps to elevate steel sheet strength through precipitate strengthening, grain-refining strengthening by inhibiting ferrite crystal grain growth, and dislocation strengthening by inhibiting recrystallization. The lower limit of Ti content is defined as 0.001% because these effects are not observed at an amount of Ti addition of less than 0.001%. The upper limit of Ti content is defined as 0.14% because heavy precipitation of carbonitrides degrades formability when Ti content exceeds 0.14%.

V: 0.001 to 0.14%

V is a strengthening element. It helps to elevate steel sheet strength through precipitate strengthening, grain-refining strengthening by inhibiting ferrite crystal grain growth, and dislocation strengthening by inhibiting recrystallization. The lower limit of V content is defined as 0.001% because these effects are not observed at an amount of V addition of less than 0.001%. The upper limit of V content is defined as 0.14% because heavy precipitation of carbonitrides degrades formability when V content exceeds 0.14%.

One or Two or More of Ca, Ce, Mg, and REM: Total of 0.0001 to 0.5%

Ca, Ce, Mg and REM are elements used for deoxidation. Incorporation of one or two or more elements selected from this group in a total content of 0.0001% or greater reduces post-deoxidation oxide size, thereby contributing to hole expansibility improvement.

However, a total content exceeding 0.5% adversely affects formability. The total content of the elements is therefore defined as 0.0001 to 0.5%. Note that REM is an abbreviation of "rare earth metals," which are elements in the lanthanoid series. REM and Ce are generally added as contained in mischmetal, which in addition to La and Ce may also contain other lanthanoid series elements in combination. The invention exhibits its effects even if lanthanoid series elements other than La and Ce are contained as unavoidable impurities. The effects of the present invention are manifested even if metallic La and Ce are added.

The reasons for defining the production conditions of the invention steel sheet will be explained next.

It is known that since martensite and bainite transform from austenite, they have a specific orientation relationship with austenite. On the other hand, it is known that in the case where a cold-rolled steel sheet is subjected to annealing in the austenite single phase region and then gradually cooled to form ferrite at the austenite grain boundaries, there may in some cases be a specific crystal orientation relationship between the austenite and ferrite.

However, when the cold-rolled steel sheet is annealed in the two-phase region, the recrystallized ferrite formed in the worked ferrite and the austenite formed with cementite and bainite present in the hot-rolled steel sheet as nuclei do not readily assume a specific crystal orientation relationship because they nucleate at different locations. FIG. 1(*ii*) schematically illustrates the state of phase transformation in the case of heating the cold-rolled steel sheet to Ac1 or greater at an ordinary temperature increase rate.

As a result, in the case of annealing in the two-phase region, it has been impossible to control the orientation relationships of the hard structures (bainite, martensite and the like) formed by transformation from ferrite and austenite present among the steel sheet structures.

The inventors conducted a study from which they discovered that hard structures having a crystal orientation difference of less than 9° relative to the ferrite main phase can be formed by, during annealing after cold rolling, controlling the crystal orientation relationship between the ferrite and austenite structures during the temperature elevation process and, in the cooling process after annealing, controlling the crystal orientation relationship of the hard structures transformed from austenite.

As a result, it became possible to produce a steel sheet of enhanced high strength without degradation of ductility or hole expansibility, i.e., simultaneously having maximum tensile strength of 540 MPa or greater, ductility and hole expansibility.

Now follows an explanation of the production conditions for conducting annealing after cold rolling so as to form hard structures whose crystal orientation difference relative to the ferrite main phase is less than 9°.

First, in the temperature elevation process during the annealing after cold rolling, the crystal orientation relationship between the ferrite and austenite structures is controlled. For this, it is necessary during passage of the steel sheet through a continuous annealing line to establish a heating rate (HR1) of 2.5 to 15° C./sec between 200 and 600° C. and a heating rate (HR2) of (0.6×HR1)° C./sec or less between 600° C. and the maximum heating temperature.

Recrystallization ordinarily occurs more readily with increasing temperature. However, transformation from cementite to austenite progresses much faster than the recrystallization. So, as shown in d of FIG. 1(*ii*), when heating is simply conducted at a high temperature, transformation from cementite to austenite occurs, and ferrite recrystallization progresses thereafter. By this, it is impossible to control the crystal orientation relationship as required by the present invention.

Moreover, since alloying elements such as C and Mn also delay recrystallization, recrystallization is slow in a high-strength steel sheet containing a large amount of these alloying elements, which makes control of the crystal orientation relationship still more difficult.

So, in the present invention, control of transformation from cementite to austenite and recrystallization of ferrite is conducted by controlling the heating rate. Specifically, as schematically illustrated in c of FIG. 1(*i*), the heating rate is controlled to complete ferrite recrystallization before transformation from cementite to austenite, and, as shown in d of FIG. 1(*i*), cementite is transformed to austenite during the ensuing heating or during annealing.

In the present invention, the heating rate (HR1) between 200 and 600° C. is defined as 15° C./sec or less in order to complete ferrite recrystallization in advance of the reaustenitisation of cementite and pearlite to austenite.

At a heating rate greater than 15° C./sec, the reaustenitisation commences before ferrite recrystallization is completed and the orientation relationship of austenite formed thereafter cannot be controlled. This is why the upper limit of the heating rate is defined as 15° C./sec or less.

The reason for defining the lower limit of the heating rate as 2.5° C./sec is as follows.

When the heating rate is less than 2.5° C./sec, the dislocation density is low, which decreases the number of recrystallized ferrite nucleation sites, so that reaustenitisation proceeds more rapidly than ferrite recrystallization even if the heating rate between 600° C. and maximum heating temperature is controlled to within the range of the present invention. As a result, the crystal orientation relationship between ferrite and austenite is lost, so that the specific orientation relationship is not present between ferrite and bainite even if holding is conducted at the predetermined temperature in the cooling process following annealing. Excellent hole expansibility, BH property, and fatigue resistance effects therefore cannot be realized. Furthermore, the decrease in recrystallized ferrite nucleation sites may cause coarsening of recrystallized ferrite and persistence of un-recrystallized ferrite. Ferrite coarsening is undesirable because it causes softening, while presence of un-recrystallized ferrite is undesirable because it strongly degrades ductility.

On the other hand, the heating rate (HR2) between 600° C. and maximum heating temperature must be (0.6×HR1)° C./sec or less.

When the steel sheet is heated to the Ac1 transformation point or higher, cementite starts to transform to austenite. The inventors learned that when the heating rate is within the aforesaid range at this time, austenite having a specific orientation relationship with ferrite can be formed at the interfaces between recrystallized ferrite and cementite. The details of the mechanism involved are unclear.

This austenite grows during heating and the ensuing cooling, and the cementite is completely transformed to austenite. As a result, it becomes possible to control the crystal orientation relationship between recrystallized ferrite and austenite even in the case of conducting annealing in the two-phase region.

When the heating rate is faster than (0.6×HR1)° C./sec, the rate of formation of austenite not having the specific orientation relationship becomes high. Therefore, even if, as indicated later, holding at 450 to 300° C. for 30 sec or greater is conducted in the post-annealing cooling process, the crystal orientation difference between the main phase ferrite and the hard structures cannot be controlled to less than 9° or less. In view of this, the heating rate upper limit is defined as (0.6×HR1)° C./sec.

Although the invention effects, namely maximum tensile strength of 540 MPa or greater and simultaneous establishment of hole expansibility and ductility, can be achieved even if the heating rate is reduced to an extremely low level, excessive heating rate reduction impairs productivity. The heating rate between 600° C. and maximum heating temperature is therefore preferably (0.1×HR1)° C./sec or greater.

The maximum heating temperature in annealing is set in the range of 760° C. to Ac3 transformation point. When this temperature is less than 760° C., too much time is required for the reaustenitisation from cementite and pearlite to austenite. Moreover, when the maximum temperature reached is less than 760° C., some cementite and pearlite cannot transform to austenite and remains in the steel sheet structure after annealing. As the cementite and pearlite are coarse, they are undesirable because they cause hole expansibility degradation. And since bainite and martensite formed by transformation of austenite, and the austenite itself, transform to martensite during working, thereby enabling realization of 540 MPa or greater strength, the failure of some cementite and pearlite to transform to austenite leads to a deficiency of hard structures and makes it impossible to achieve strength of 540 MPa or greater. The lower limit of the maximum heating temperature must therefore be defined as 760° C.

On the other hand, increasing the heating temperature excessively is economically undesirable. So the upper limit of the heating temperature is preferably the Ac3 transformation point (Ac3° C.).

The Ac3 transformation point is determined by the following formula:

$$Ac3=910-203\times(C)^{1/2}+44.7\times Si-30\times Mn+700\times P+400\times Al-11\times Cr-20\times Cu-15.2\times Ni+31.5\times Mo+400\times Ti.$$

After annealing, cooling between 630° C. and 570° C. at an average cooling rate of 3° C./sec or greater is required.

When the cooling rate is too low, austenite transforms to pearlite structure in the cooling process, so that the amount of hard structures required for strength of 540 MPa or greater cannot be secured. Although increasing the cooling rate causes no problem with regard to steel quality, excessive increase of the cooling rate increases production cost, so the upper limit is preferably defined as 200° C./sec. The cooling method can be any of roll cooling, air cooling, water cooling, or a combination of these.

In the present invention, it is next necessary to hold the steel sheet in the temperature range of 450° C. to 300° C. for 30 sec or greater. This is for transforming austenite to bainite and martensite of a crystal orientation difference of less than 9° relative to the main phase ferrite.

When the holding is conducted in a temperature range exceeding 450° C., hole expansibility is severely degraded owing to precipitation of coarse cementite at the grain boundaries. The upper limit temperature is therefore defined as 450° C. On the other hand, when the holding temperature is less than 300° C., almost no bainite or martensite of a crystal orientation difference of less than 9° is formed, so that it is impossible to secure an adequate volume fraction of hard structures whose crystal orientation difference relative to the main phase ferrite is less than 9°. Hole expansibility therefore becomes markedly inferior. So the temperature of 300° C. during holding for 30 sec or greater is the lower limit temperature.

When the holding time in the temperature range of 450° C. to 300° C. is less than 30 sec, bainite and martensite of a crystal orientation difference of less than 9° may be formed, but the volume fraction thereof is inadequate and the remaining austenite transforms to martensite in the ensuing cooling process, so that most of the hard structures come to have a crystal orientation difference of 9° or greater, which makes hole expansibility inferior. The lower limit of the residence time is therefore defined as 30 sec or greater. Although the effects of the present invention can be obtained without need for setting an upper limit for the residence time, increasing the residence time is undesirable because, in carrying out heat treatment using equipment of limited length, it amounts to operating at a reduced steel sheet passage speed and is therefore uneconomical.

In this invention, "holding" does not mean just isothermal holding but refers to residence time in the 450 to 300° C. temperature range. In other words, it is acceptable to heat to 450° C. after once cooling to 300° C. or to cool to 300° C. after heating to 450° C.

However, this process of holding in the 450 to 300° C. temperature range must be conducted immediately after the earlier cooling between 630° C. and 570° C. at an average cooling rate of 3° C./sec or greater, and if the temperature is once lowered to below 300° C. in the process of cooling between 630° C. and 570° C. at an average cooling rate of 3° C./sec or greater, the crystal orientation difference can no longer be controlled even by reheating to and holding in the 450 to 300° C. temperature range.

The above explanation of the production of the steel sheet of the present invention by applying the foregoing annealing to the cold rolled steel sheet will now be followed by an explanation of the production conditions and other conditions up to the annealing, including explanation of best modes for practicing the invention.

A steel having the aforesaid chemical composition is produced by melting in a converter, electric furnace or the like, the molten steel is subjected to vacuum degassing as required and then cast into a slab.

In the present invention, the slab subjected to hot rolling is not particularly limited. Any slab, such a continuously cast slab or one produced with a thin slab caster or the like is acceptable. The invention is also compatible with the continuous casting-direct rolling (CC-DR) process or other such processes that conduct hot rolling immediately after casting.

The hot-rolled slab heating temperature must be 1,050° C. or greater. If the slab heating temperature is too low, the finish rolling temperature falls below the Ar3 transformation point, and as this results in ferrite and austenite two-phase rolling, the hot-rolled sheet assumes an uneven mixed grain structure which remains uneven even after the cold rolling and annealing processes and makes ductility and hole expansibility inferior.

Since the steel according the present invention is made to contain relatively large amounts of alloying elements in order ensure maximum tensile strength of 540 Mpa or greater after annealing, its strength during finish rolling also tends to be high. A decline in slab heating temperature causes a decline in finish rolling temperature, which further increases rolling load, making rolling difficult and raising a concern of shape defects occurring in the rolled steel sheet. The slab heating temperature must therefore be defined as 1,050° C. or greater.

Although the effects of the present invention are exhibited without particularly setting an upper limit of the slab heating temperature, an excessively high heating temperature is undesirable from the viewpoint of economy, so the upper limit of the heating temperature is preferably defined as less than 1,300° C.

The finish rolling temperature is controlled to Ar3 transformation point or greater. When the finish rolling temperature is in the austenite+ferrite two-phase region, the structural inhomogeneity in the steel sheet increases to degrade post-annealing formability. The finish rolling temperature is therefore preferably the Ar3 transformation temperature or greater.

The Ar3 transformation temperature can be ascertained from on the alloy composition by calculation using the following formula:

$$Ar3=901-325\times C+33\times Si-92\times(Mn+Ni/2+Cr/2+Cu/2+Mo/2).$$

Although the effects of the present invention are exhibited without particularly setting an upper limit of the finishing temperature, use of a finish rolling temperature that is excessively high requires the temperature to be established by making the slab heating temperature high. The upper limit of the finish rolling temperature is therefore preferably defined as 1,000° C. or less.

The coiling temperature after hot rolling is defined as 670° C. or less. At higher than 670° C., coarse ferrite and pearlite come to be present in the hot-rolled structure, which increases the post-annealing structural inhomogeneity and degrades the ductility of the final product. Coiling at a temperature of 600° C. or less is more preferable from the viewpoint of refining the post-annealing structure to enhance the strength-ductility balance, uniformly disperse the two phases, and improve hole expansibility.

Coiling at a temperature higher than 670° C. is undesirable because it degrades pickling performance by excessively increasing the thickness of oxides formed on the steel sheet surface. Although the effects of the present invention are exhibited without particularly setting a lower limit of the coiling temperature, room temperature is the substantial lower limit because coiling at a temperature below room temperature is difficult technically. It is worth noting that during hot rolling, rough-rolled sheets can be joined to conduct finish rolling continuously. It is also possible to once coil the rough-rolled sheet.

The hot-rolled steel sheet produced in this manner is pickled. Pickling enables removal of oxides from the steel sheet surface and is therefore important for improving the chemical treatment property of the final product cold-rolled, high-strength steel sheet, and the hot-dip plating property of the cold-rolled steel sheet for hot-dip galvanizing or alloyed hot-dip galvanizing. The pickling can be conducted as a single operation or divided into a number of operations.

The pickled hot-rolled steel sheet is cold rolled at a reduction of 40 to 70% and passed through a continuous annealing line or a continuous hot-dip galvanization line. At a reduction of less than 40%, it is difficult to maintain a flat shape. And the ductility of the final product declines. The lower reduction limit is therefore defined as 40%.

The upper reduction limit is defined as 70% because cold rolling at a greater reduction than this is difficult owing to occurrence of excessive cold-rolling load. The preferable reduction range is 45 to 65%. The present invention exhibits its effects without any particular need to specify the number of rolling passes or the rolling reduction in the respective passes.

In the case of passage through a continuous annealing line, heating must be conducted at a heating rate (HR1) of 2.5 to 15° C./sec between 200 and 600° C. and a heating rate (HR2) of (0.6×HR1)° C./sec or less between 600° C. and maximum heating temperature. Such heating is conducted to control the crystal orientation difference between main phase ferrite and austenite.

After heat treatment, skin-pass rolling is preferable performed in order to control surface roughness, control sheet shape, and inhibit yield point elongation. The rolling reduction in this skin-pass rolling is preferably in the range of 0.1 to 1.5%. The lower limit of the skin-pass rolling reduction is defined as 0.1% because at less than 0.1% the effect is small and control is difficult. The upper limit is defined as 1.5% because productivity declines markedly above 1.5%. The skin-pass rolling can be conducted either in-line or off-line. The skin-pass rolling can be conducted to the desired reduction in a single pass or a number of passes.

In the case of passing the cold-rolled steel sheet through a hot-dip galvanization line, the heating rate (HR1) in the 200 to 600° C. temperature range is, for the same reason as in the case of passage through a continuous annealing line, defined as 2.5 to 15° C./sec. The heating rate between 600° C. and maximum heating temperature is, also for the same reason as in the case of passage through a continuous annealing line, defined as (0.6×HR1)° C./sec.

The maximum heating temperature in this case is, also for the same reason as in the case of passage through a continuous annealing line, defined to fall in the range of 760° C. to Ac3 transformation point. Further, the post-annealing cooling is, also for the same reason as in the case of passage through a continuous annealing line, required to be 3° C./sec or greater between 630° C. and 570° C.

The sheet temperature at immersion in the galvanizing bath is preferably in the temperature region between 40° C. lower than the hot-dip galvanizing bath and 50° C. higher than the hot-dip galvanizing bath.

The lower limit of the sheet bath-immersion temperature is defined as (hot-dip galvanizing bath temperature−40)° C. because when it is lower than this temperature, the heat extraction at bath entry becomes large, causing some of the molten zinc to solidify, which degrades the plating appearance. However, when the sheet temperature before immersion is below (hot-dip galvanizing bath temperature−40)° C., the sheet can be reheated before immersion in the galvanizing bath to a sheet temperature of (hot-dip galvanizing bath temperature−40)° C. or higher and then be immersed in the galvanizing bath. When the galvanizing bath immersion temperature exceeds (hot-dip galvanizing bath temperature+50)° C., the resulting rise in the galvanizing bath temperature causes an operational problem. The galvanizing bath can be a pure zinc bath or can additionally contain Fe, Al, Mg, Mn, Si, Cr and other elements.

When the plating layer is alloyed, the alloying is conducted at 460° C. or greater. When the alloying treatment temperature is less than 460° C., alloying proceeds slowly, so that productivity is poor. Although no particular upper limit is defined, the substantial upper limit is 600° C. because when the temperature exceeds 600° C., carbides form to lower the volume fraction of hard structures (martensite, bainite, and retained austenite), making it difficult to ensure strength of 540 MPa or greater.

Additional heat treatment of holding the steel sheet in the temperature range of (hot-dip galvanizing bath temperature+50)° C. to 300° C. for 30 sec or greater must be conducted before, after or both before and after immersion in the galvanizing bath.

The reason for defining the upper limit of this heat treatment temperature as (hot-dip galvanizing bath temperature+50)° C. is that above this temperature significant formation of cementite and pearlite lowers the volume fraction of hard structures to make achievement of a strength of 540 MPa or greater difficult. On the other hand, when the temperature is less than 300° C., then, for a reason not completely understood, hard structures of a crystal orientation difference greater than 9° are abundantly formed, so that an adequate volume fraction of hard structures with a crystal orientation difference relative to the main phase ferrite of less than 9° cannot be secured. The lower limit of the heat treatment temperature is therefore defined as 300° C. or greater.

The holding time must be 30 sec or greater. When the holding time is less than 30 sec, then, for a reason not completely understood, hard structures of a crystal orientation difference greater than 9° are abundantly formed, so that an adequate volume fraction of hard structures with a crystal orientation difference of less than 9° cannot be secured and hole expansibility therefore becomes inferior. For this reason, the lower limit of the residence time is defined as 30 sec or greater.

Although the effects of the present invention can be obtained without need for setting an upper limit of the residence time, increasing the residence time is undesirable because, in carrying out heat treatment using equipment of limited length, it amounts to operating at a reduced steel sheet passage speed and is therefore uneconomical.

The holding time in this case does not mean just isothermal holding time but refers to residence time in the temperature range, and gradual cooling and heating within the temperature range are also included.

The additional heat treatment in the temperature range of (hot-dip galvanizing bath temperature+50)° C. to 300° C. for 30 sec or greater can also be conducted before, after or both before and after immersion in the galvanizing bath. The reason is that insofar as hard structures of a crystal orientation difference relative to the main phase ferrite of less than 9° can be secured, the invention effects, namely strength of 540 MPa or greater and excellent ductility and hole expansibility, can be obtained irrespective of the conditions under which the additional heat treatment is conducted.

After heat treatment, skin-pass rolling is preferably performed in order to control surface roughness, control sheet shape, and inhibit yield point elongation. The rolling reduction in this skin-pass rolling is preferably in the range of 0.1 to 1.5%. The lower limit of the skin-pass rolling reduction is defined as 0.1% because at less than 0.1% the effect is small and control is difficult. The upper limit is defined as 1.5% because productivity declines markedly above 1.5%. The skin-pass rolling can be conducted either in-line or off-line. The skin-pass rolling can be conducted to the desired reduction in a single pass or a number of passes.

Further, application of plating that, for the purpose of further enhancing plating adhesion, contains Ni, Cu, Co and Fe individually or in combination does not depart from the gist of the present invention.

Further, different processes are available for the pre-plating annealing, including: the Sendzimir process of "After degreasing and pickling, heating in a non-oxidizing atmosphere, annealing in a reducing atmosphere containing $H_2$ and $N_2$, cooling to near the plating bath temperature, and immersing in the plating bath;" the total reduction furnace method of "Regulating the atmosphere during annealing, first oxidizing the steel sheet surface, then performing reduction to conduct cleaning prior to plating, and thereafter immersing in the plating bath;" and the flux process of "Degreasing and pickling the steel sheet, conducting flux treatment using ammonium chloride or the like, and immersing in the plating bath." The invention exhibits its effects irrespective of the conditions under which the treatment is conducted.

Moreover, without need for a pre-plating annealing technique, it works to the advantage of plating wettability and the alloying reaction in the case of alloying the plating to control the dew point during heating to minus 20° C. or greater.

It should also be noted that electroplating of the cold-rolled steel sheet in no way deprives the steel sheet of the tensile strength, ductility or hole expansibility it possesses. In other words, the steel sheet of the present invention is also suitable as a material for electroplating. The effects of the present invention can also be obtained in a steel sheet that is provided with an organic coating or upper plating layer.

Although the high-strength, high-ductility, hot-dip galvanized steel sheet material excellent in formability and hole expansibility according to the present invention is, in principle, produced through the ordinary ironmaking processes of refining, steelmaking, casting, hot rolling and cold rolling, even if it is produced without conducting some or all of these processes, it nevertheless exhibits the effects of the present invention insofar as the conditions according to the present invention are satisfied.

EXAMPLES

Examples of the present invention are explained in detail in the following.

Slabs having the compositions shown in Table 1 were each heated to 1,200° C., hot rolled at a finish hot-rolling temperature of 900° C., water cooled in a water-cooling zone, and then coiled at the temperature shown in Table 2 or 3. The hot-rolled sheet was pickled, whereafter the 3-mm thick hot-rolled sheet was cold-rolled to 1.2 mm to obtain a cold-rolled sheet.

Each of the cold-rolled sheets was anneal heat treated under the conditions shown in Table 2 or 3, and annealed using an annealing line. The furnace atmosphere was established by attaching an apparatus for introducing $H_2O$ and $CO_2$ generated by burning a mixed gas of CO and $H_2$, and introducing $N_2$ gas containing 10 vol % of $H_2$ and controlled to have a dew point of minus 40° C. Annealing was conducted under the conditions shown in Table 2 or 3.

The galvanized steel sheets were annealed and galvanizes using a continuous hot-dip galvanization line. The furnace atmosphere was established to ensure platability by attaching an apparatus for introducing $H_2O$ and $CO_2$ generated by burning a mixed gas of CO and $H_2$, and introducing $N_2$ gas containing 10 vol % of $H_2$ and controlled to have a dew point of minus 10° C. Annealing was conducted under the conditions shown in Table 2 or 3. Particularly in the case of the high Si-content steels designated C, F and H, since non-plating defects and alloying delay tended to occur if the foregoing furnace atmosphere control was not performed, the atmosphere (oxygen potential) had to be controlled in the case of subjecting steels of high Si content to hot-dip plating or alloying treatment.

Next, some of the steel sheets were subjected to alloying treatment in the temperature range of 480 to 590° C. The coating weight of the hot-dip zinc plating of the galvanized steel sheets was about 50 g/m$^2$ per side. Finally, the obtained steel sheets were skin-pass rolled at a reduction of 0.4%.

TABLE 1

(mass %)

| Steel symbol | C | Si | Mn | P | S | Al | N | O | Other | Ac3 temp | Example type |
|---|---|---|---|---|---|---|---|---|---|---|---|
| A | 0.092 | 0.48 | 1.83 | 0.009 | 0.0023 | 0.019 | 0.0024 | 0.0023 | — | 829 | Invention |
| B | 0.088 | 0.88 | 1.77 | 0.008 | 0.0011 | 0.022 | 0.0022 | 0.0025 | — | 850 | Invention |
| C | 0.101 | 1.23 | 1.74 | 0.009 | 0.0024 | 0.028 | 0.0029 | 0.0018 | — | 866 | Invention |
| D | 0.079 | 0.74 | 1.84 | 0.009 | 0.0035 | 0.016 | 0.0031 | 0.0046 | Ca = 0.0011 | 844 | Invention |
| E | 0.081 | 0.52 | 1.57 | 0.011 | 0.0022 | 0.032 | 0.0018 | 0.0017 | Cr = 0.46 | 844 | Invention |
| F | 0.122 | 1.33 | 1.84 | 0.007 | 0.0018 | 0.033 | 0.0024 | 0.0021 | — | 861 | Invention |
| G | 0.095 | 0.48 | 2.39 | 0.009 | 0.0022 | 0.021 | 0.0027 | 0.0016 | B = 0.0007 | 812 | Invention |
| H | 0.112 | 1.12 | 1.71 | 0.008 | 0.0016 | 0.027 | 0.0028 | 0.0028 | Ni = 0.62, Cu = 0.32 | 841 | Invention |
| I | 0.181 | 0.72 | 2.38 | 0.018 | 0.0022 | 0.023 | 0.0024 | 0.0025 | Nb = 0.028 | 806 | Invention |
| J | 0.169 | 0.53 | 2.54 | 0.011 | 0.0042 | 0.004 | 0.0026 | 0.0023 | Ti = 0.046, Ce = 0.0008 | 801 | Invention |
| K | 0.088 | 0.72 | 2.17 | 0.016 | 0.0019 | 0.014 | 0.0023 | 0.0024 | Nb = 0.037, Ti = 0.019, Mo = 0.14, B = 0.0028 | 841 | Invention |
| L | 0.095 | 0.01 | 1.12 | 0.0026 | 0.0046 | 0.024 | 0.0063 | 0.0037 | — | 846 | Comparative |
| M | 0.034 | 0.42 | 1.76 | 0.013 | 0.0038 | 0.037 | 0.0022 | 0.0032 | — | 882 | Comparative |
| N | 0.098 | 0.34 | 3.2 | 0.013 | 0.0033 | 0.024 | 0.0026 | 0.0027 | Ti = 0.017, B = 0.0019 | 804 | Comparative |

Underlining indicates condition outside the scope of the invention (Also in Tables 2 to 5)

TABLE 2

| Steel symbol | Product sheet type*1 | Hot-mill coiling temp (° C.) | HR1 (° C./s) | HR2 (° C./s) | Anneal temp (° C.) | 630~570° C. ave. cooling rate (° C./s) | Heat treatment temp (° C.) | Alloying temp (° C.) | Example Type |
|---|---|---|---|---|---|---|---|---|---|
| A-1 | CR | 580 | 8.6 | 1.5 | 800 | 23 | 360 | —*2 | Invention |
| A-2 | CR | 560 | 80 | 20 | 800 | 23 | 320 | —*2 | Comparative |
| A-3 | CR | 580 | 30 | 30 | 800 | 23 | 320 | —*2 | Comparative |
| A-4 | CR | 550 | 4.2 | 0.7 | 800 | 23 | 320 | —*2 | Invention |
| A-5 | CR | 560 | 9.9 | 2.2 | 800 | 23 | 400 | —*2 | Invention |
| A-6 | CR | 620 | 8.6 | 1.5 | 800 | 23 | 280 | —*2 | Comparative |
| A-7 | CR | 580 | 8.6 | 1.5 | 800 | 105 | 360 | —*2 | Invention |
| A-8 | CR | 540 | 7.9 | 1.3 | 820 | 19 | 360 | —*2 | Invention |
| A-9 | CR | 570 | 8.9 | 1.6 | 780 | 26 | 360 | —*2 | Invention |
| A-10 | GI | 580 | 8.6 | 1.5 | 800 | 4.6 | 420 | —*2 | Invention |
| A-11 | GI | 560 | 8.6 | 1.5 | 800 | 4.6 | 220 | —*2 | Comparative |
| A-12 | GA | 590 | 8.6 | 1.5 | 800 | 4.6 | 460 | 540 | Invention |
| A-13 | GA | 570 | 11.2 | 2.4 | 800 | 4.6 | 470 | 480 | Invention |
| A-14 | GA | 570 | 11.2 | 2.4 | 800 | 4.6 | 560 | 590 | Comparative |
| A-15 | GA | 620 | 11.2 | 2.4 | 800 | 4.6 | —*2 | 540 | Comparative |
| A-16 | GA | 560 | 11.2 | 2.4 | 800 | 0.4 | 460 | 540 | Comparative |
| A-17 | GA | 720 | 11.2 | 2.4 | 800 | 4.6 | 510 | 540 | Comparative |
| B-1 | CR | 550 | 8.6 | 1.5 | 800 | 23 | 360 | —*2 | Invention |
| B-2 | GI | 480 | 11.2 | 2.4 | 800 | 4.6 | 420 | —*2 | Invention |
| B-3 | GA | 570 | 11.2 | 2.4 | 800 | 4.6 | 450 | 520 | Invention |
| C-1 | CR | 570 | 8.3 | 1.3 | 840 | 23 | 360 | —*2 | Invention |
| C-2 | CR | 690 | 6.8 | 1.2 | 780 | 44 | 280 | —*2 | Comparative |
| C-3 | CR | 560 | 8.6 | 1.5 | 800 | 23 | 570 | —*2 | Comparative |
| C-4 | CR | 610 | 50 | 50 | 780 | 23 | 320 | —*2 | Comparative |
| C-5 | CR | 440 | 8.6 | 1.5 | 740 | 23 | 360 | —*2 | Comparative |
| C-6 | GI | 590 | 10.8 | 2.2 | 820 | 4.6 | 420 | —*2 | Invention |
| C-7 | GA | 580 | 10.8 | 2.2 | 820 | 4.6 | 450 | 510 | Invention |
| D-1 | CR | 560 | 8.6 | 1.5 | 800 | 23 | 360 | —*2 | Invention |
| E-1 | CR | 590 | 8.6 | 1.5 | 800 | 23 | 360 | —*2 | Invention |
| F-1 | CR | 580 | 8.6 | 1.5 | 800 | 23 | 360 | —*2 | Invention |
| F-2 | GI | 560 | 11.2 | 2.4 | 800 | 4.6 | 420 | —*2 | Invention |
| F-3 | GA | 540 | 11.2 | 2.4 | 800 | 4.6 | 440 | 520 | Invention |

*1CR: Cold rolled steel sheet, GI: Hot-dip galvanized steel sheet, GA: Alloyed hot-dip galvanized steel sheet
*2"—" indicates that the process was not conducted.

TABLE 3

(continued from Table 2)

| Steel symbol | Product sheet type*1 | Hot-mill coiling temp (° C.) | HR1 (° C./s) | HR2 (° C./s) | Anneal temp (° C.) | 630~570° C. ave. cooling rate (° C./s) | Heat treatment temp (° C.) | Alloying temp (° C.) | Example Type |
|---|---|---|---|---|---|---|---|---|---|
| G-1 | CR | 530 | 8.6 | 1.5 | 790 | 23 | 320 | —*2 | Invention |
| G-2 | CR | 580 | 8.6 | 1.5 | 790 | 23 | 360 | —*2 | Invention |
| G-3 | CR | 600 | 12.6 | 3.6 | 810 | 86 | 230 | —*2 | Comparative |
| G-4 | CR | 600 | 80 | 80 | 810 | 90 | 360 | —*2 | Comparative |
| G-5 | GI | 540 | 11.2 | 2.4 | 790 | 4.6 | 420 | —*2 | Invention |
| G-6 | GA | 540 | 11.2 | 2.4 | 790 | 4.6 | 440 | 480 | Invention |
| G-7 | GA | 590 | 11.2 | 2.4 | 790 | 4.6 | —*2 | 520 | Comparative |
| H-1 | CR | 560 | 8.6 | 1.5 | 800 | 23 | 380 | —*2 | Invention |
| H-2 | CR | 570 | 8.6 | 1.5 | 800 | 23 | 260 | —*2 | Comparative |
| H-3 | CR | 570 | 8.6 | 1.5 | 800 | 23 | 480 | —*2 | Comparative |
| H-4 | GI | 590 | 11.2 | 2.4 | 800 | 4.6 | 410 | —*2 | Invention |
| H-5 | GA | 610 | 11.2 | 2.4 | 800 | 4.6 | 440 | 480 | Invention |
| H-6 | GA | 610 | 11.2 | 2.4 | 800 | 4.6 | 530 | 560 | Comparative |
| H-7 | GA | 570 | 11.2 | 2.4 | 800 | 4.6 | —*2 | 520 | Comparative |
| I-1 | CR | 540 | 6.8 | 1.4 | 790 | 44 | 360 | —*2 | Invention |
| I-2 | CR | 490 | 6.8 | 1.4 | 790 | 62 | 260 | —*2 | Comparative |
| I-3 | CR | 530 | 20 | 35 | 780 | 23 | 360 | —*2 | Comparative |
| J-1 | CR | 530 | 8.6 | 1.5 | 790 | 28 | 350 | —*2 | Invention |
| K-1 | CR | 530 | 8.6 | 1.5 | 800 | 28 | 320 | —*2 | Invention |
| K-2 | CR | 520 | 8.6 | 1.5 | 830 | 23 | 360 | —*2 | Invention |
| K-3 | CR | 550 | 20 | 35 | 830 | 23 | 360 | —*2 | Comparative |
| K-4 | CR | 530 | 90 | 12 | 830 | 23 | 360 | —*2 | Comparative |
| K-5 | CR | 530 | 8.6 | 1.5 | 800 | 42 | 270 | —*2 | Comparative |
| K-6 | GI | 520 | 11.2 | 2.4 | 800 | 4.6 | 410 | —*2 | Invention |
| K-7 | GA | 530 | 11.2 | 2.4 | 800 | 4.6 | 440 | 480 | Invention |

TABLE 3-continued (continued from Table 2)

| Steel symbol | Product sheet type*1 | Hot-mill coiling temp (° C.) | HR1 (° C./s) | HR2 (° C./s) | Anneal temp (° C.) | 630~570° C. ave. cooling rate (° C./s) | Heat treatment temp (° C.) | Alloying temp (° C.) | Example Type |
|---|---|---|---|---|---|---|---|---|---|
| K-8 | GA | 600 | 70 | 60 | 800 | 4.6 | 460 | 520 | Comparative |
| K-9 | GA | 540 | 11.2 | 2.4 | 800 | 4.6 | —*2 | 480 | Comparative |
| L-1 | CR | 600 | 8.6 | 1.5 | 800 | 23 | 360 | —*2 | Comparative |
| L-2 | GI | 590 | 11.2 | 2.4 | 800 | 4.6 | 420 | —*2 | Comparative |
| L-3 | GA | 600 | 11.2 | 2.4 | 800 | 4.6 | 440 | 520 | Comparative |
| M-1 | CR | 490 | 8.6 | 1.5 | 800 | 23 | 360 | —*2 | Comparative |
| M-2 | GI | 520 | 11.2 | 2.4 | 800 | 4.6 | 420 | —*2 | Comparative |
| M-3 | GA | 500 | 11.2 | 2.4 | 800 | 4.6 | 440 | 520 | Comparative |
| N-1 | CR | 600 | 8.6 | 1.5 | 800 | 23 | 360 | —*2 | Comparative |
| N-2 | GI | 590 | 11.2 | 2.4 | 800 | 4.6 | 420 | —*2 | Comparative |
| N-3 | GA | 590 | 11.2 | 2.4 | 800 | 4.6 | 440 | 520 | Comparative |

The obtained cold-rolled steel sheets, hot-dip galvanized steel sheets and alloyed hot-dip galvanized steel sheets were tensile tested to determine their yield stress (YS), maximum tensile stress, and total elongation (El). Hole expansion testing was also performed to measure hole expansion ratio.

Owing to their composite structure, the steel sheets of the present invention often do not exhibit yield point elongation. Yield stress was therefore measured by the 0.2%-offset method. Samples that had a TS×El of 16,000 (MPa×%) or greater were deemed to be high-strength steel sheets with good strength-ductility balance.

To evaluate hole expansion ratio (λ), a 10-mm diameter circular hole was punched at a clearance of 12.5% and, with the burring as the die side, the hole was expanded with a 60° conical punch. The hole expansion test was repeated five times under each set of conditions and the average of the five test results was defined as the hole expansion ratio. Samples that had a TS×λ of 40,000 (MPa×%) or greater were deemed to be high-strength steel sheets with good strength-hole expansibility balance.

Samples that had both good strength-ductility balance and good strength-hole expansibility balance were deemed to be high-strength steel sheets with excellent hole expansibility-ductility balance.

Fatigue resistance measurement was conducted in accordance with the Method of Plane Bending Fatigue Testing described in JIS Z 2275. The test was conducted at a stress ratio of minus 1 and rate of bending repetition of 30 Hz using a JIS No. 1 test piece having a gauge region of a minimum width of 20 mm and R=42.5 mm. Testing was conducted at n=3 at each stress and the maximum stress at which all of the n=3 test pieces remained un-fractured after 10 million repetition cycles was deemed the fatigue strength. The value obtained by dividing this value by the maximum tensile stress was called the fatigue limit ratio (=Fatigue strength/Maximum tensile strength) and a sample having a fatigue limit ratio of 0.5 or greater was deemed to be a steel sheet excellent in fatigue resistance.

Next, the steel sheet microstructures were determined and the crystal orientation relationship between the ferrite and hard structures was measured.

In the microstructure determination, the technique described earlier was used to identify the different structures. However, retained austenite may, when its chemical stability is low, transform to martensite if it loses grain boundary constraint from surrounding crystal grains because of polishing or free surface exposure at the time the test piece is prepared for microstructure observation. As a result, a difference may arise between the volume fraction of retained austenite contained in the steel sheet as directly measured such as by X-ray measurement and that of the retained austenite present at the surface measured after free surface exposure by polishing or the like.

In this invention, it was necessary to measure the crystal orientation relationship between the main phase ferrite and the hard structures by the FESEM-EBSP technique. The microstructures were therefore determined after surface polishing.

The orientation difference between adjacent ferrite and hard structure was measured by the aforesaid technique and rated as follows:

E (Excellent): Proportion of all hard structures accounted for by hard structures with crystal orientation difference of less than 9° is 50% or greater, F (Fair): Proportion of all hard structures accounted for by hard structures with crystal orientation difference of less than 9° is 30% or greater, P: (Poor): Proportion of all hard structures accounted for by hard structures with crystal orientation difference of less than 9° is less than 30%.

A particularly marked improvement in hole expansion ratio is observed when the proportion of all hard structures accounted for by hard structures with crystal orientation difference of less than 9° is 50% or greater. This range was therefore defined as the invention range.

Figure 2:
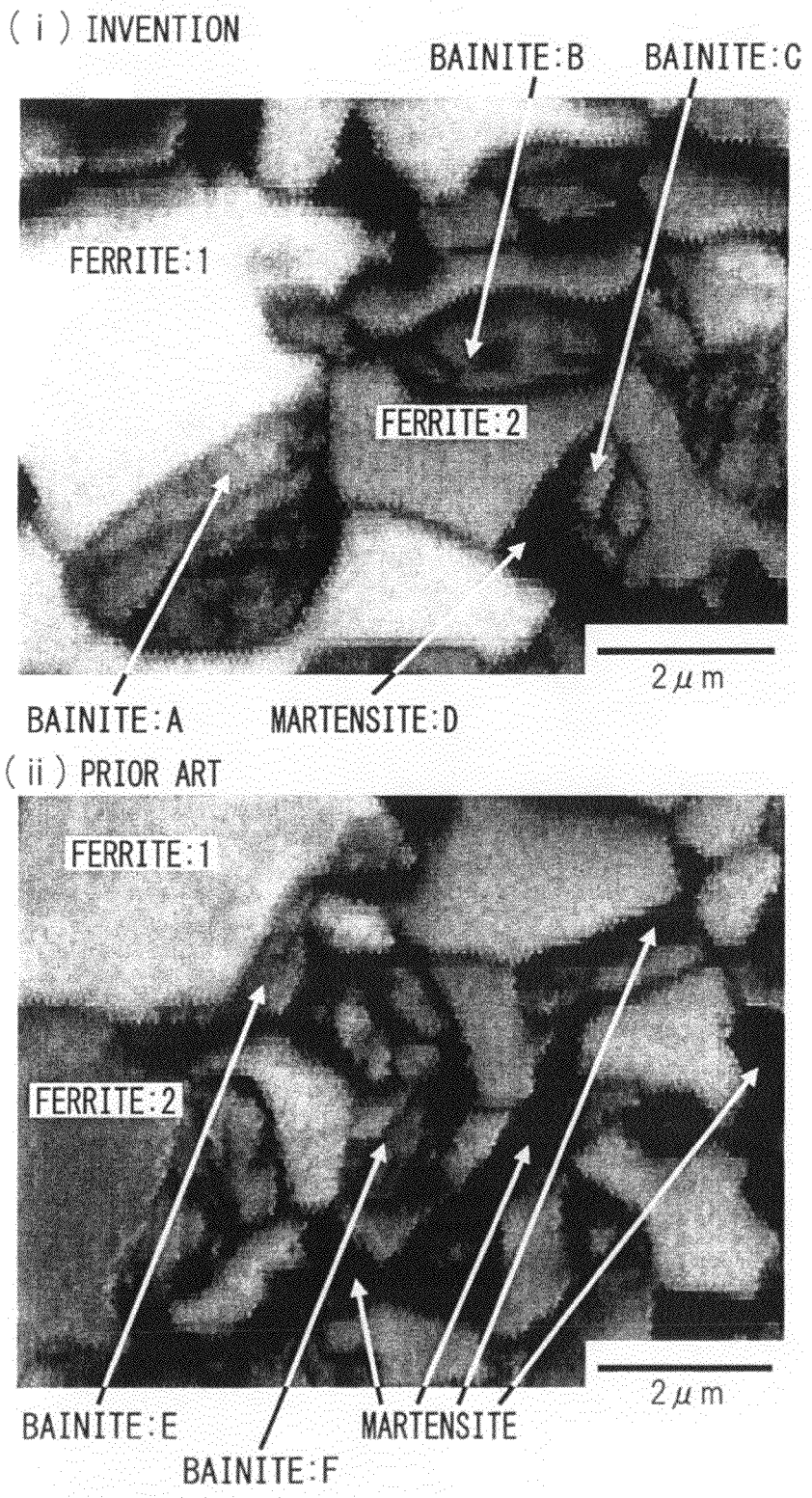
FIG. 2 is a set of image examples by FESEM-EBSP Image Quality (IQ) mapping obtained from steel sheets after annealing, wherein (i) indicates the case of the present invention and (ii) indicates the case of the prior art.

FIG. 2 is a set of image examples by FESEM-EBSP Image Quality (IQ) mapping obtained from invention and comparative steel sheets.

In the invention steel sheet (i), the crystal orientation differences between ferrite: 1 and adjacent bainite: A and between ferrite 2: and adjacent bainite: B, C are all less than 9°, and martensite: D is surrounded by bainite C. In contrast, in the comparative steel sheet (ii), bainite: E, F both have crystal orientation differences of greater than 9° relative to all ferrite adjacent thereto.

Tables 4 and 5 show the measurement results for the obtained steel sheets.

TABLE 4

| Steel symbol. | Product type*1 | Structures: Main phase*3 | Structures: Hard structures*3 | Structures: Residual structures*3 | Structure ratios: F | Structure ratios: B | Structure ratios: M | Structure ratios: RA | Ferrite/Hard structure Crystal orientation difference | Transformation point (° C.): Bs | Transformation point (° C.): Ms |
|---|---|---|---|---|---|---|---|---|---|---|---|
| A-1 | CR | F | B, M, RA | — | 87 | 5 | 6 | 2 | E | 474 | 165 |
| A-2 | CR | F | B, M, RA | — | 87 | 4 | 7 | 2 | P | 474 | 165 |
| A-3 | CR | F | B, M, RA | — | 87 | 4 | 7 | 2 | P | 474 | 165 |
| A-4 | CR | F | B, M, RA | — | 87 | 5 | 6 | 2 | E | 474 | 165 |
| A-5 | CR | F | B, RA | — | 88 | 4 | 6 | 2 | E | 458 | 137 |
| A-6 | CR | F | M, RA | — | 88 | 0 | 11 | 1 | F | 458 | 137 |
| A-7 | CR | F | B, M, RA | — | 86 | 4 | 6 | 4 | E | 488 | 189 |
| A-8 | CR | F | B, M, RA | — | 88 | 3 | 7 | 2 | E | 458 | 137 |
| A-9 | CR | F | B, M, RA | — | 90 | 3 | 5 | 2 | E | 417 | 65 |
| A-10 | GI | F | B, M, RA | — | 87 | 5 | 6 | 2 | E | 474 | 165 |
| A-11 | GI | F | B, M | — | 87 | 6 | 7 | 0 | P | 474 | 165 |
| A-12 | GA | F | B, M, RA | — | 87 | 4 | 6 | 3 | E | 474 | 165 |
| A-13 | GA | F | B, M, RA | — | 87 | 4 | 6 | 3 | E | 474 | 165 |
| A-14 | GA | F | P | — | 87 | 6 | 7 | 0 | P | 474 | 165 |
| A-15 | GA | F | B, M | — | 87 | 4 | 9 | 0 | P | 474 | 165 |
| A-16 | GA | F | P | — | 89 | 11 | 0 | 0 | P | 439 | 104 |
| A-17 | GA | F | B, M, RA | — | 90 | 3 | 6 | 1 | F | 417 | 65 |
| B-1 | CR | F | B, M, RA | — | 87 | 5 | 6 | 2 | E | 488 | 182 |
| B-2 | GI | F | B, M, RA | — | 88 | 4 | 6 | 2 | E | 473 | 155 |
| B-3 | GA | F | B, M, RA | — | 88 | 3 | 7 | 2 | E | 473 | 155 |
| C-1 | CR | F | B, M, RA | — | 85 | 6 | 6 | 3 | E | 492 | 184 |
| C-2 | CR | F | M, RA | — | 86 | 0 | 13 | 1 | P | 479 | 162 |
| C-3 | CR | F | B, M, RA | — | 86 | 4 | 7 | 3 | F | 479 | 162 |
| C-4 | CR | F | B, M, RA | — | 87 | 5 | 7 | 1 | P | 464 | 135 |
| C-5 | CR | F | — | C | 94 | 6 | 0 | 0 | P | 219 | —*4 |
| C-6 | GI | F | B, M, RA | — | 87 | 4 | 6 | 3 | E | 464 | 135 |
| C-7 | GA | F | B, M, RA | — | 87 | 5 | 6 | 2 | E | 464 | 135 |
| D-1 | CR | F | B, M, RA | — | 88 | 4 | 6 | 2 | E | 487 | 188 |
| E-1 | CR | F | B, M, RA | — | 88 | 3 | 7 | 2 | E | 499 | 157 |
| F-1 | CR | F | B, M, RA | — | 83 | 7 | 7 | 3 | E | 471 | 160 |
| F-2 | GI | F | B, M, RA | — | 84 | 5 | 6 | 5 | E | 459 | 139 |
| F-3 | GA | F | B, M, RA | — | 84 | 6 | 6 | 4 | E | 459 | 139 |

| Steel symbol. | Tensile properties: YS (MPa) | Tensile properties: TS (MPa) | Tensile properties: El (%) | Tensile properties: λ (%) | Tensile properties: TS · El (%) | Tensile properties: TS · λ (%) | Fatigue limit ratio at 10 million cycles | Example type |
|---|---|---|---|---|---|---|---|---|
| A-1 | 355 | 602 | 31.0 | 103.00 | 18662 | 62006 | 0.55 | Invention |
| A-2 | 339 | 645 | 29.0 | 51.00 | 18705 | 32895 | 0.42 | Comparative |
| A-3 | 341 | 648 | 29.0 | 49.00 | 18792 | 31752 | 0.43 | Comparative |
| A-4 | 347 | 633 | 30.0 | 86.00 | 18990 | 54438 | 0.54 | Invention |
| A-5 | 368 | 597 | 32.0 | 99.00 | 19104 | 59103 | 0.61 | Invention |
| A-6 | 332 | 667 | 28.0 | 53.00 | 18676 | 35351 | 0.42 | Comparative |
| A-7 | 358 | 608 | 31.0 | 109.00 | 18848 | 66272 | 0.55 | Invention |
| A-8 | 356 | 606 | 30.0 | 114.00 | 18180 | 69084 | 0.53 | Invention |
| A-9 | 348 | 601 | 32.0 | 95.00 | 19232 | 57095 | 0.51 | Invention |
| A-10 | 352 | 612 | 30.0 | 90.00 | 18360 | 55080 | 0.57 | Invention |
| A-11 | 334 | 661 | 28.0 | 39.00 | 18508 | 25779 | 0.42 | Comparative |
| A-12 | 349 | 623 | 29.0 | 81.00 | 18067 | 50463 | 0.53 | Invention |
| A-13 | 352 | 619 | 30.0 | 87.00 | 18570 | 53853 | 0.55 | Invention |
| A-14 | 361 | 554 | 28.0 | 66.00 | 15512 | 36564 | 0.41 | Comparative |
| A-15 | 334 | 645 | 29.0 | 55.00 | 18705 | 35475 | 0.39 | Comparative |
| A-16 | 356 | 548 | 29.0 | 69.00 | 15892 | 37812 | 0.43 | Comparative |
| A-17 | 348 | 651 | 29.0 | 56.00 | 18879 | 36456 | 0.43 | Comparative |
| B-1 | 352 | 624 | 32.0 | 92.00 | 19968 | 57408 | 0.55 | Invention |
| B-2 | 345 | 633 | 30.0 | 89.00 | 18990 | 56337 | 0.51 | Invention |
| B-3 | 342 | 638 | 30.0 | 95.00 | 19140 | 60610 | 0.53 | Invention |
| C-1 | 355 | 629 | 36.0 | 91.00 | 22644 | 57239 | 0.56 | Invention |
| C-2 | 355 | 667 | 29.0 | 41.00 | 19343 | 27347 | 0.43 | Comparative |
| C-3 | 367 | 652 | 31.0 | 52.00 | 20212 | 33904 | 0.38 | Comparative |
| C-4 | 359 | 661 | 29.0 | 44.00 | 19169 | 29084 | 0.43 | Comparative |
| C-5 | 371 | 571 | 28.0 | 64.00 | 15988 | 36544 | 0.44 | Comparative |
| C-6 | 388 | 633 | 34.0 | 86.00 | 21522 | 54438 | 0.52 | Invention |
| C-7 | 391 | 629 | 35.0 | 89.00 | 22015 | 55981 | 0.56 | Invention |
| D-1 | 346 | 613 | 30.0 | 118.00 | 18390 | 72334 | 0.60 | Invention |
| E-1 | 354 | 609 | 31.0 | 92.00 | 18879 | 56028 | 0.54 | Invention |
| F-1 | 411 | 698 | 26.0 | 86.00 | 18148 | 60028 | 0.52 | Invention |

TABLE 4-continued

| | | | | | | | | | |
|---|---|---|---|---|---|---|---|---|---|
| | F-2 | 398 | 716 | 25.0 | 82.00 | 17900 | 58712 | 0.55 | Invention |
| | F-3 | 396 | 708 | 26.0 | 76.00 | 18408 | 53808 | 0.53 | Invention |

*3F: Ferrite, P: Pearlite, B: Bainite, M: Martensite, RA: Retained austenite, C: Cementite

*4Indicates that bainite and martensite did not transform because austenite decomposed before martensite transformation.

TABLE 5

(continued from Table 4)

| Steel symbol. | Product type*1 | Structures: Main phase*3 | Structures: Hard structures*3 | Structures: Residual structures*3 | Structure ratios: F | B | M | RA | Ferrite/Hard structure Crystal orientation difference | Transformation point (° C.): Bs | Ms |
|---|---|---|---|---|---|---|---|---|---|---|---|
| G-1 | CR | F | B, M, RA | — | 76 | 10 | 12 | 2 | E | 508 | 295 |
| G-2 | CR | F | B, M, RA | — | 76 | 8 | 11 | 5 | E | 508 | 295 |
| G-3 | CR | F | M | — | 74 | 0 | 26 | 0 | P | 516 | 309 |
| G-4 | CR | F | B, M, RA | — | 79 | 10 | 10 | 1 | P | 493 | 268 |
| G-5 | GI | F | B, M, RA | — | 78 | 8 | 10 | 4 | E | 498 | 278 |
| G-6 | GA | F | B, M, RA | — | 78 | 8 | 10 | 4 | E | 498 | 278 |
| G-7 | GA | F | M, RA | — | 79 | 0 | 20 | 1 | P | 493 | 268 |
| H-1 | CR | F | B, M, RA | — | 83 | 6 | 8 | 3 | E | 475 | 182 |
| H-2 | CR | F | M | — | 84 | 0 | 16 | 0 | P | 464 | 162 |
| H-3 | CR | F | B, M, RA | — | 84 | 4 | 10 | 2 | F | 464 | 162 |
| H-4 | GI | F | B, M, RA | — | 85 | 6 | 7 | 2 | E | 452 | 140 |
| H-5 | GA | F | B, M, RA | — | 85 | 3 | 9 | 3 | E | 452 | 140 |
| H-6 | GA | F | B, M, RA | — | 86 | 1 | 11 | 2 | F | 437 | 115 |
| H-7 | GA | F | M, RA | — | 85 | 0 | 14 | 1 | P | 452 | 140 |
| I-1 | CR | F | B, M, RA | — | 66 | 16 | 16 | 2 | E | 472 | 230 |
| I-2 | CR | F | M | — | 65 | 0 | 35 | 0 | P | 476 | 237 |
| I-3 | CR | F | B, M, RA | — | 67 | 30 | 1 | 2 | P | 468 | 222 |
| J-1 | CR | F | B, M, RA | — | 68 | 13 | 17 | 2 | E | 459 | 227 |
| K-1 | CR | F | B, M, RA | — | 76 | 8 | 14 | 2 | E | 524 | 300 |
| K-2 | CR | F | B, M, RA | — | 75 | 10 | 13 | 2 | E | 528 | 307 |
| K-3 | CR | F | B, M, RA | — | 78 | 19 | 2 | 1 | P | 515 | 285 |
| K-4 | CR | F | B, M, RA | — | 76 | 21 | 1 | 2 | P | 524 | 300 |
| K-5 | CR | F | M | — | 77 | 0 | 23 | 0 | P | 520 | 293 |
| K-6 | GI | F | B, M, RA | — | 79 | 9 | 11 | 1 | E | 510 | 276 |
| K-7 | GA | F | B, M, RA | — | 79 | 8 | 11 | 2 | E | 510 | 276 |
| K-8 | GA | F | B, M, RA | — | 80 | 12 | 5 | 3 | P | 504 | 266 |
| K-9 | GA | F | M, RA | — | 79 | 0 | 19 | 2 | P | 510 | 276 |
| L-1 | CR | F | P | — | 89 | 11 | 0 | 0 | P | 496 | —*5 |
| L-2 | GI | F | P | — | 91 | 9 | 0 | 0 | P | 444 | —*5 |
| L-3 | GA | F | P | — | 91 | 9 | 0 | 0 | P | 444 | —*5 |
| M-1 | CR | F | B, A | — | 94 | 5 | 0 | 1 | E | 519 | 234 |
| M-2 | GI | F | B, A | — | 95 | 4 | 0 | 1 | E | 488 | 181 |
| M-3 | GA | F | B, A | — | 95 | 4 | 0 | 1 | E | 488 | 181 |
| N-1 | CR | M | B | — | 0 | 62 | 38 | 0 | —*4 | 516 | 409 |
| N-2 | GI | M | B | — | 0 | 52 | 48 | 0 | —*4 | 516 | 409 |
| N-3 | GA | M | B | — | 0 | 38 | 62 | 0 | —*4 | 516 | 409 |

| Steel symbol. | Tensile properties: YS (MPa) | TS (MPa) | El (%) | λ (%) | TS · El (%) | TS · λ (%) | Fatigue limit ratio at 10 million cycles | Example type |
|---|---|---|---|---|---|---|---|---|
| G-1 | 501 | 827 | 22.0 | 76.00 | 18194 | 62852 | 0.55 | Invention |
| G-2 | 509 | 799 | 23.0 | 82.00 | 18377 | 65518 | 0.52 | Invention |
| G-3 | 475 | 872 | 22.0 | 31.00 | 19184 | 27032 | 0.43 | Comparative |
| G-4 | 624 | 924 | 12.0 | 46.00 | 11088 | 42504 | 0.56 | Comparative |
| G-5 | 521 | 809 | 23.0 | 80.00 | 18607 | 64720 | 0.52 | Invention |
| G-6 | 499 | 822 | 23.0 | 74.00 | 18906 | 60828 | 0.55 | Invention |
| G-7 | 516 | 818 | 22.0 | 27.00 | 17996 | 22086 | 0.44 | Comparative |
| H-1 | 523 | 805 | 28.0 | 69.00 | 22540 | 55545 | 0.52 | Invention |
| H-2 | 549 | 908 | 19.0 | 28.00 | 17252 | 25424 | 0.39 | Comparative |
| H-3 | 524 | 869 | 23.0 | 38.00 | 19987 | 33022 | 0.40 | Comparative |
| H-4 | 526 | 812 | 27.0 | 64.00 | 21924 | 51968 | 0.52 | Invention |
| H-5 | 529 | 821 | 26.0 | 61.00 | 21346 | 50081 | 0.54 | Invention |
| H-6 | 503 | 868 | 23.0 | 39.00 | 19964 | 33852 | 0.38 | Comparative |
| H-7 | 510 | 873 | 21.0 | 34.00 | 18333 | 29682 | 0.42 | Comparative |
| I-1 | 706 | 1023 | 16.0 | 61.00 | 16368 | 62403 | 0.51 | Invention |
| I-2 | 700 | 1121 | 14.0 | 19.00 | 15694 | 21299 | 0.42 | Comparative |

TABLE 5-continued (continued from Table 4)

| | | | | | | | | |
|---|---|---|---|---|---|---|---|---|
| I-3 | 811 | 1098 | 11.0 | 27.00 | 12078 | 29646 | 0.38 | Comparative |
| J-1 | 722 | 1003 | 16 | 75 | 16048 | 75225 | 0.51 | Invention |
| K-1 | 711 | 1056 | 16 | 62 | 16896 | 65472 | 0.52 | Invention |
| K-2 | 735 | 1011 | 18 | 71 | 18198 | 71781 | 0.51 | Invention |
| K-3 | 882 | 1107 | 9 | 24 | 9963 | 26568 | 0.42 | Comparative |
| K-4 | 869 | 1127 | 8 | 27 | 9016 | 30429 | 0.42 | Comparative |
| K-5 | 674 | 1121 | 15 | 19 | 16815 | 21299 | 0.43 | Comparative |
| K-6 | 685 | 1023 | 16 | 55 | 16368 | 56265 | 0.51 | Invention |
| K-7 | 689 | 1018 | 18 | 52 | 18324 | 52936 | 0.53 | Invention |
| K-8 | 785 | 1098 | 11 | 26 | 12078 | 28548 | 0.39 | Comparative |
| K-9 | 675 | 1098 | 14 | 22 | 15372 | 24156 | 0.42 | Comparative |
| L-1 | 310 | 452 | 35 | 124 | 15820 | 56048 | 0.43 | Comparative |
| L-2 | 307 | 458 | 34 | 138 | 15572 | 63204 | 0.42 | Comparative |
| L-3 | 301 | 450 | 35 | 134 | 15750 | 60300 | 0.44 | Comparative |
| M-1 | 231 | 477 | 35 | 112 | 16695 | 53424 | 0.44 | Comparative |
| M-2 | 225 | 485 | 34 | 131 | 16490 | 63535 | 0.44 | Comparative |
| M-3 | 239 | 466 | 37 | 119 | 17242 | 55454 | 0.44 | Comparative |
| N-1 | 842 | 1023 | 9 | 98 | 9207 | 100254 | 0.42 | Comparative |
| N-2 | 819 | 1017 | 9 | 100 | 9153 | 101700 | 0.43 | Comparative |
| N-3 | 854 | 1004 | 8 | 85 | 8032 | 85340 | 0.44 | Comparative |

*5Assumed two-phase martensite and bainite structure because ferrite did not transform owing to high Mn content In the steels designated A-1, 4, 5, 7 to 10, 12 and 13, B-1 to 3, C-1, 6 and 7, D-1, E-1, F-1 to 3, G-1, 2, 5 and 6, H-1, 4 and 5, I-1, J-1, and K-1, 2, 6 and 7 in Tables 4 and 5, the chemical compositions of the steel sheets were within the range specified by the present invention and their production conditions were also within the ranges specified by the present invention. As a result, the proportion of the hard structures whose crystal orientation difference relative to the main phase ferrite was less than 9° was large, so that the use of hard structures for structure strengthening did not degrade hole expansibility. In other words, a high level of hole expansibility could be secured while also exploiting the improvement in strength-ductility balance owing to structure strengthening. And fatigue resistance was simultaneously improved.

As a result, it was possible to produce steel sheet of a maximum tensile strength of 540 MPa or greater that had an extremely good balance between ductility and hole expansibility, as well as good fatigue resistance.

On the other hand, in the steels designated A-2 and 3, C-4, G-4, I-3, and K-3, 4 and 8 in Table 4 and 5, the heating conditions did not satisfy the range requirements of the present invention, and since the proportion of hard structures whose crystal orientation difference relative to ferrite was greater than 9° was therefore large, the value of the hole expansibility index TS×λ was low, i.e. less than 40,000 (MPa×%), so that hole expansibility was poor. Further, the fatigue limit ratio at 10 million cycles was below 0.5, indicating that no effect of fatigue resistance improvement was observed.

In the steels designated A-6, 11, 14 and 15, C-2 and 3, G-3 and 7, H-2, 3, 6 and 7, 1-2, and K-5 and 9 in Table 4 and 5, the fact that, with the cold rolled steel sheets, the residence time in the temperature range of 300 to 450° C. was less than 30 sec, and that, with the hot-dip galvanized steel sheets and alloyed hot-dip galvanized steel sheets, the residence time in the temperature range of (galvanizing bath temperature+50)° C. to 300° C. was less than 30 sec, caused the proportion of hard structures whose crystal orientation difference relative to ferrite was greater than 9° to be large, so that the value of the hole expansibility index TS×λ was low, i.e. less than 40,000 (MPa×%), and hole expansibility was therefore poor. Further, the fatigue limit ratio was below 0.5, indicating that no effect of fatigue resistance improvement was observed.

In the steel designated A-16 in Table 4, high strength could not be realized because austenite transformed to pearlite as a result of the excessively slow cooling rate in the temperature range of 630 to 570° C. Moreover, the strength-ductility balance, hole expansibility and fatigue resistance were all poor.

In the steel designated C-5 in Table 4, the low annealing temperature of 740° C. caused pearlite formed during hot rolling and cementite formed by spheroidization of pearlite to remain in the steel sheet structure, and as this made it impossible to secure an adequate volume fraction of bainite and martensite hard structures, high strength could not be realized. Moreover, the strength-ductility balance, hole expansibility and fatigue resistance were all poor.

In the steels designated L-1 to 3 in Table 5, owing to the low Si and Mn contents of 0.01% and 1.12%, respectively, it was impossible in the post-annealing cooling process to inhibit pearlite transformation so as to secure hard structures like bainite, martensite and retained austenite, so that high strength of 540 MPa or greater could not be established.

In the steels designated M-1 to 3 in Table 5, the low C content of 0.034% made it impossible to secure an adequate amount of hard structures, so that high strength of 540 MPa or greater could not be established.

In the steels designated N-1 to 3 in Table 5, owing to the high Mn content of 3.2%, once the ferrite volume fraction declined during annealing, an adequate amount of ferrite could not be produced in the cooling process. As a result, the strength-ductility balance was markedly inferior.

In addition, the steel sheets of these steels had fatigue limit ratios below 0.5, indicating that no effect of fatigue resistance improvement was observed.

INDUSTRIAL APPLICABILITY

This invention provides, at low cost, steel sheets whose maximum tensile strength of 540 MPa or greater is ideally suitable for automotive structural members, reinforcement members and suspension members, which combine good ductility and hole expansibility to offer highly excellent formability, and which are also excellent in fatigue resistance. As these sheets are highly suitable for use in, for example, automotive structural members, reinforcement members and suspension members, they can be expected to make a great contribution to automobile weight reduction and thus have a very beneficial effect on industry.

What is claimed is:

1. A high-strength cold rolled steel sheet having very good balance between hole expansibility and ductility, and also excellent in fatigue resistance, characterized in:

comprising, in mass %,

C: 0.05% to 0.20%,

Si: 0.3 to 2.0%,

Mn: 1.3 to 2.6%,

P: 0.001 to 0.03%,

S: 0.0001 to 0.01%,

Al: 2.0% or less,

N: 0.0005 to 0.0100%,

O: 0.0005 to 0.007%, and a balance of iron and unavoidable impurities; and having a steel sheet structure composed mainly of, in vol %, ferrite: greater than 50% and hard structure: 5% or greater, wherein said hard structure is composed of bainite, martensite, and residual austenite, and 50% or greater, in vol %, of the entire hard structure has a crystal orientation difference between some ferrite adjacent to hard structure and the hard structure of less than 9°, and a maximum tensile strength of 540 MPa or greater, wherein said crystal structure orientation difference is a value composed of both a [1-1-1] crystal orientation difference and a crystal orientation difference in the direction normal to the (110) plane.

2. A high-strength cold rolled steel sheet having very good balance between hole expansibility and ductility, and also excellent in fatigue resistance, according to claim 1, further comprising, in mass %, B: 0.0001 to less than 0.010%.

3. A high-strength cold rolled steel sheet having very good balance between hole expansibility and ductility, and also excellent in fatigue resistance, according to claim 1, further comprising, in mass %, one or two or more of:

Cr: 0.01 to 1.0%,

Ni: 0.01 to 1.0%,

Cu: 0.01 to 1.0%, and

Mo: 0.01 to 1.0%.

4. A high-strength cold rolled steel sheet having very good balance between hole expansibility and ductility, and also excellent in fatigue resistance, according to claim 1, further comprising, in mass %, one or two or more of Nb, Ti and V in a total of 0.001 to 0.14%.

5. A high-strength cold rolled steel sheet having very good balance between hole expansibility and ductility, and also excellent in fatigue resistance, according to claim 1, further comprising, in mass %, one or two or more of Ca, Ce, Mg, and REM in a total of 0.0001 to 0.5%.

6. A high-strength galvanized cold rolled steel sheet having very good balance between hole expansibility and ductility, and also excellent in fatigue resistance, comprising a steel sheet in accordance with claim 1 having a zinc-based plating on its surface.

7. A method of producing a high-strength cold rolled steel sheet having very good balance between hole expansibility and ductility, and also excellent in fatigue resistance, characterized in heating a cast slab having a chemical composition in accordance with claim 1, directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous annealing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater; and holding in a temperature range of 450° C. to 300° C. for 30 sec or greater.

8. A method of producing a high-strength hot-dip galvanized cold rolled steel sheet having very good balance between hole expansibility and ductility, and also excellent in fatigue resistance, characterized in heating a cast slab having a chemical composition in accordance with any of claim 1, directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous hot-dip galvanizing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater to a temperature of (galvanizing bath temperature −40)° C. to (galvanizing bath temperature +50)° C.; and holding in a temperature range of (galvanizing bath temperature +50)° C. to 300° C. for 30 sec or greater either before or after or both before and after immersion in the galvanizing bath.

9. A method of producing a high-strength alloyed hot-dip galvanized cold rolled steel sheet having very good balance between hole expansibility and ductility, and also excellent in fatigue resistance, characterized in heating a cast slab having a chemical composition in accordance with claim 1, directly or after once cooling, to 1,050° C. or greater; completing hot rolling at or above Ar3 transformation point; coiling in a temperature range of 400 to 670° C.; pickling followed by cold rolling reduction of 40 to 70%; during passage through a continuous hot-dip galvanizing line, heating at a heating rate (HR1) of 2.5 to 15° C./sec between 200 and 600° C. and a heating rate (HR2) of (0.6×HR1)° C./sec or less between 600° C. and maximum heating temperature; annealing with the maximum heating temperature set at 760° C. to Ac3 transformation point; cooling between 630° C. and 570° C. at an average cooling rate of 3° C./sec or greater to a temperature of (galvanizing bath temperature −40)° C. to (galvanizing bath temperature +50)° C.; conducting alloying treatment at a temperature of 460 to 540° C. as required, and holding in a temperature range of (galvanizing bath temperature +50)° C. to 300° C. for 30 sec or greater before or after immersion in the galvanizing bath or after alloying treatment or in total.

10. A method of producing a high-strength electro-galvanized cold rolled steel sheet having very good balance between hole expansibility and ductility, and also excellent in fatigue resistance, characterized in electro-galvanizing a steel sheet produced in accordance with the method of claim 7.

* * * * *

UNITED STATES PATENT AND TRADEMARK OFFICE

CERTIFICATE OF CORRECTION

PATENT NO. : 8,460,481 B2
APPLICATION NO. : 12/736417
DATED : June 11, 2013
INVENTOR(S) : Masafumi Azuma et al.

It is certified that error appears in the above-identified patent and that said Letters Patent is hereby corrected as shown below:

In the Specification

Column 2, line 16, change "540. MPa" to -- 540 MPa --;

Column 9, line 2, change "This because" to -- This is because --;

Column 9, line 8, change "within) $_9$° ," to -- within 9°), --;

Column 16, line 56, change "(Ac3° C.)." to -- (Ac3 °C). --;

Column 19, line 26, change "is preferable" to -- is preferably --;

Column 31, line 55, change "6 and 7, 1-2" to -- 6 and 7, I-2 --.

Signed and Sealed this
Twenty-fourth Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,460,481 B2
APPLICATION NO. : 12/736417
DATED : June 11, 2013
INVENTOR(S) : Azuma et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 170 days.

Signed and Sealed this
Eighth Day of September, 2015

Michelle K. Lee

Michelle K. Lee
*Director of the United States Patent and Trademark Office*